United States Patent [19]

Lehmann

[11] 3,970,301

[45] July 20, 1976

[54] THREE-DIMENSIONAL NETWORK

[76] Inventor: Conrad Roland Lehmann, Bismarckallee 4, 1 Berlin 33, Germany

[22] Filed: Aug. 15, 1974

[21] Appl. No.: 497,823

Related U.S. Application Data

[63] Continuation-in-part of Ser. No. 456,124, March 29, 1974, abandoned.

[30] Foreign Application Priority Data

Mar. 29, 1973 Germany ..... 2316141

[52] U.S. Cl. ..... 272/113; 52/648

[51] Int. Cl.[2] ..... A63B 7/04; A63B 17/04

[58] Field of Search ..... 272/60 R; 52/81, 83, 52/648, DIG. 10

[56] References Cited

UNITED STATES PATENTS

| | | | |
|---|---|---|---|
| 1,141,967 | 6/1915 | Lacoste | 52/648 |
| 3,008,711 | 11/1961 | Dillon | 272/60 R |
| 3,411,250 | 11/1968 | Maymont et al. | 52/81 |
| 3,722,153 | 3/1973 | Baer | 52/648 |
| 3,794,316 | 2/1974 | Toman | 272/60 R |

*Primary Examiner*—Richard C. Pinkham
*Assistant Examiner*—Harry G. Strappello
*Attorney, Agent, or Firm*—Woodhams, Blanchard and Flynn

[57] ABSTRACT

A spatial network, in particular a climbing device for children. The climbing device is composed of a three-dimensional inner net of tensile members and a three-dimensional outer net which serves to hold the inner net. The three-dimensional outer net consists of tensile members forming polyhedral and polygonal curved edges and doubly-curved faces. The polyhedra have a maximum of eight verticies and have their faces, in operation, at an angle to the vertical. The three-dimensional inner net consists wholly or partly of at least one continuous ring, in particular a rope ring. The ring forms several interlinked polygonal meshes such as polygonal faces defined by its edges which consist of the tensile members.

48 Claims, 117 Drawing Figures

THREE-DIMENSIONAL NETWORK

This application is a continuation-in-part application of my co-pending application Ser. No. 456,124, filed Mar. 29, 1974, now abandoned.

This invention relates to spatial networks and in particular, although not so restricted to climbing and play appliances for children.

Although the present invention is primarily directed to any novel integer or step, or combination of integers or steps, herein disclosed and/or shown in the accompanying drawings, nevertheless, according to one particular aspect of the present invention to which, however, the invention is in no way restricted, there is provided a spatial network consisting of a three-dimensional inner net of tensionally rigid members, and a three-dimensional outer net from which the inner net is supported, the outer net having polygonally curved perimeter nets and tensionally rigid peripheral members, the inner net consisting wholly or partly of at least one ring and the outer net being polyhedral in shape with a maximum of eight vertices and having its faces, in operation, at an angle to the vertical.

In one embodiment the inner net consists of truncated tetrahedra and is built up from rings of interlinked triangular and quadrilateral meshes.

In another embodiment the inner net consists of truncated octahedra and is built up from rings of interlinked quadrilateral meshes.

In another embodiment the inner net consists of truncated cubes, truncated tetrahedra and truncated cuboctahedra and is built up from rings of interlinked quadrilateral meshes and triangular meshes.

In a further embodiment the inner net consists of cubes and truncated cubes and is built up from rings of interlinked quadrilateral meshes and hexagonal meshes.

In a still further embodiment the inner net consists of truncated octahedra, cubes and truncated cuboctahedra and is built up of rings of interlinked quadrilateral meshes and octagonal meshes.

In another embodiment the inner net consists of octagonal prisms and truncated cuboctahedra and is built up from rings of interlinked octagonal meshes.

In another embodiment the inner net consists of rhombic dodecahedra and is built up from rings of interlinked rhombic quadrilateral meshes.

In another embodiment the inner net is built up from rings of interlinked hexagonal meshes.

In another embodiment the inner net consists of octahedra and truncated cubes and is built up from octahedra connected to one another by connecting rings, chains or connecting rod members. In this embodiment two or more octahedra may be built up from a single ring.

In another embodiment the inner net consists of cuboctahedra, truncated octahedra and truncated tetrahedra and is built up from cuboctahedra connected to one another by connecting rings, chains or connecting rod members.

In another embodiment the inner net consists of cuboctahedra, cubes an rhombicuboctahedra and is built up from cuboctahedra connected to one another with quadrilateral connecting rings, quadrilateral connecting surfaces or net surfaces. In this embodiment the rhombicuboctahedra may be formed from a single element and may be connected to one another directly at their vertices.

In another embodiment the inner net consists of rhombicuboctahedra, cubes and tetrahedra, and is built up from rhombicuboctahedra which are connected to one another with connecting rings, chains or quadrilateral connecting surfaces.

In another embodiment the inner net consists of octahedra and cuboctahedra and is built up from either octahedra or cuboctahedra connected together.

In another embodiment the inner net consists of octahedra and tetrahedra and is built up from octahedra connected to one another by circular rings.

In another embodiment the inner net consists of triangular prisms and hexagonal prisms and is built up from planar rings with triangular or hexagonal meshes, and from a plurality of rectilinear members.

In another embodiment the inner net consists of cubes or hexahedra with quadrilateral meshes and is built up from planar rings with quadrilateral meshes and from a plurality of rectilinear members.

In another embodiment the inner net consists of triangular prisms and is built up from planar rings with triangular meshes and from a plurality of rectilinear members.

In another embodiment the inner net is in the form of a diamond grid and is built up from zig-zag rings which extend in mutually perpendicular planes.

In another embodiment the inner net consists of truncated part-octahedra with only 16 edges and is built up from zig-zag rings with quadrilateral meshes.

In another embodiment the inner net is built up from zig-zag rings with triangular meshes and whose plan is a net of triangles and dodecahedrons.

In another embodiment the inner net consists of part-octahedra with eight edges, part-tetrahedra with six edges and of zig-zag rings which extend around one or more of the sides of the part-octahedra.

Preferably the outer net has the shape of any one of a tetrahedron, hemioctahedron, hexadeltahedron, an octahedron, a triangular prism, a pentahedron, a heptahedron, a five-sided pyramid, a six-sided pyramid, a hexahedron, a rhombohedron, a hemicuboctahedron, a cubic antiprism, a truncated tetrahedron and a truncated hemioctahedron.

The outer net may have at least one truncated vertex thus at least two outer nets may be provided connected together in the region of their vertices.

The spatial network may include at least one compressively rigid rod member for supporting or assisting in supporting the network. A plurality of compressively rigid rod members may be provided each with a transverse strut secured to the inner net. Alternatively the spatial network may include a rigid ring fixed to the inner net and/or outer net, a said rod member passing through said rigid ring.

In an alternative embodiment the spatial network may include an inflatable tubular structure or inflatable cushion element for supporting or assisting in supporting the network.

The spatial network recited above may include at least one S-shaped hook for connecting together at least two tensionally rigid members, the said hook being clamped to said tensionally rigid members. The two loops of the hook may be in mutually perpendicular planes.

The spatial network may include plane elements such as fabric membranes, sheets, boards etc, connected to the network.

The invention is illustrated, merely by way of example, in the accompanying drawings, in which.

Figure 12A:
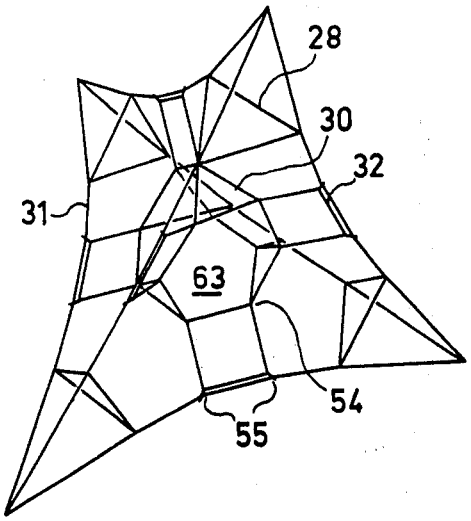
Figure 12B:
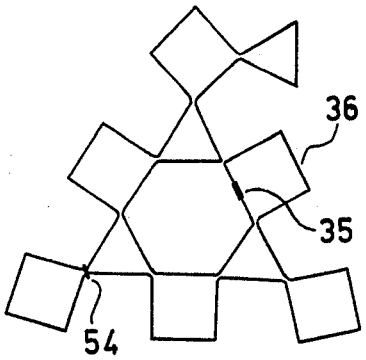

FIG. 12*a* is a perspective view of a simple spatial network in accordance with the present invention;

FIG. 12*b* is a plan projection of an inner net of the spatial netowrk of FIG. 12*a;*

Figure 13A:
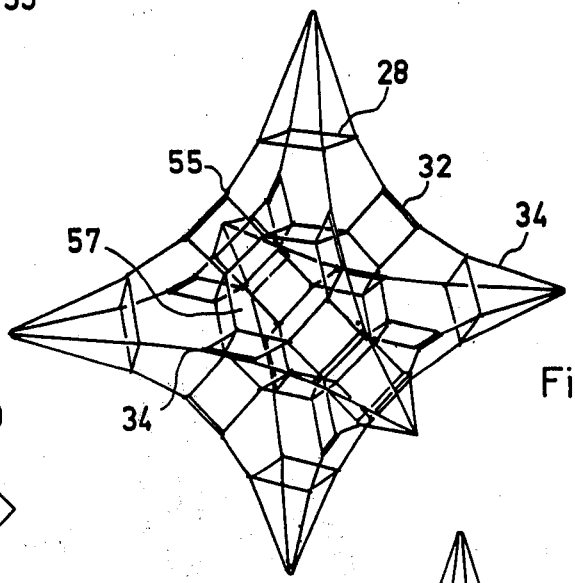
Figure 13B:
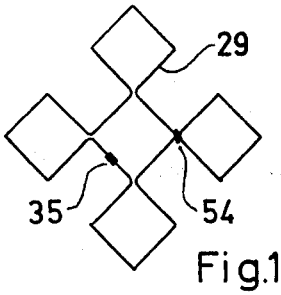

FIG. 13*a* is a perspective view of a further spatial network in accordance with the present invention;

FIG. 13*b* is a plan projection of a rope ring of the spatial network of FIG. 13*a;*

Figure 13C:
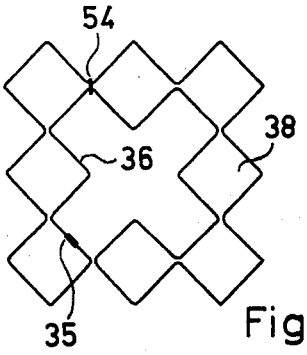

FIG. 13*c* is a plan projection of another rope ring of the spatial network of FIG. 13*a;*

Figure 13D:
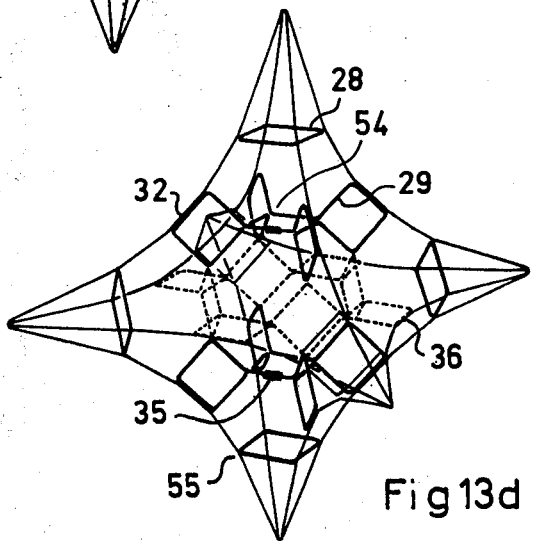

FIG. 13*d* is a schematic view illustrating the construction of the spatial network of FIG. 13*a;*

Figure 14B:
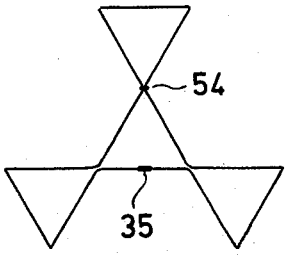
Figure 14A:
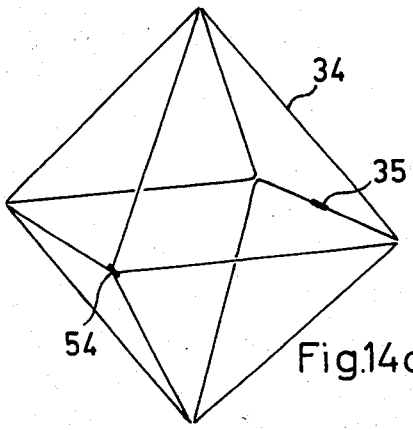
Figure 15A:
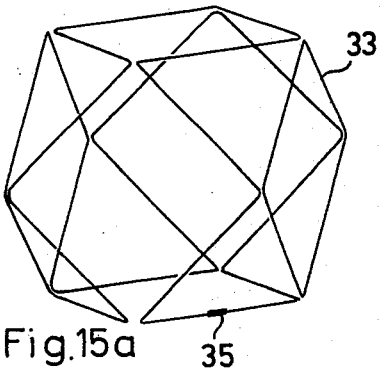
Figure 15B:
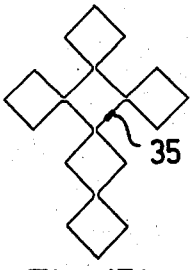

FIGS. 14*a*, 14*b* show, in perspective and plan projection respectively an octahedral rope ring for a spatial network in accordance with the present invention;

FIG. 15*a* is a perspective view of a cuboctahedral rope ring for a spatial network in accordance with the present invention;

FIG. 15*b* is a plan projection of the rope ring of FIG. 15*a;*

Figure 15C:
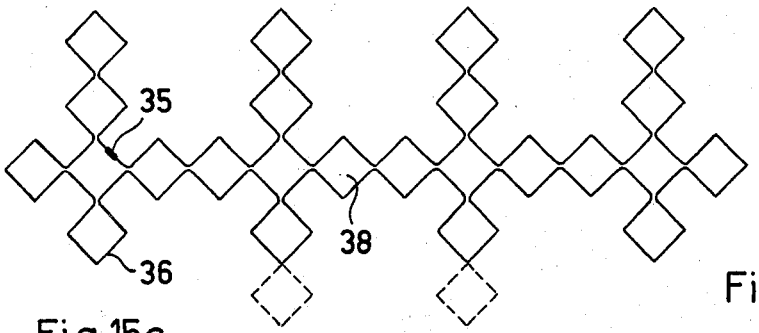

FIG. 15*c* is a plan projection of a rope ring consisting of four rope rings as illustrated in FIG. 15*a;*

Figure 15D:
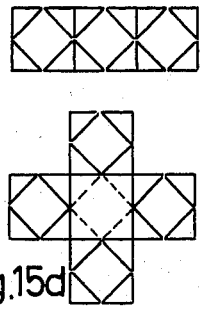

FIG. 15*d* is a side view of the rope ring of FIG. 15*c;*

Figure 16:
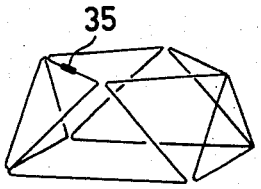
Figure 17B:
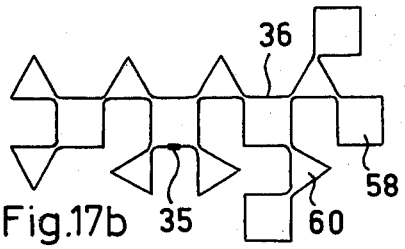
Figure 17A:
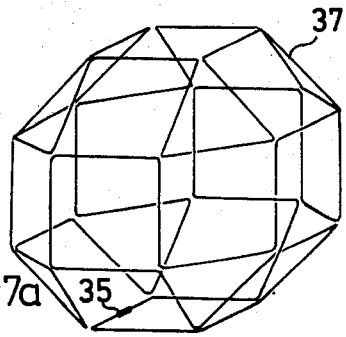

FIG. 16 is a perspective view of a hemicuboctahedral rope ring for a spatial network in accordance with the present invention;

FIG. 17*a* is a perspective view of a rhombicuboctahedral rope ring for a spatial network in accordance with the present invention;

FIG. 17*b* is a plan projection of the rope ring of FIG. 17*a;*

Figure 18A:
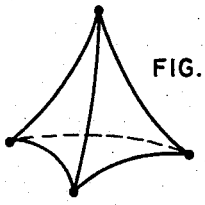
Figure 18C:
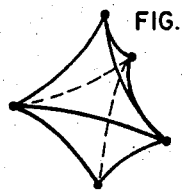
Figure 18B:
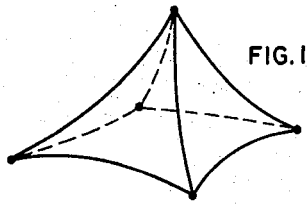
Figure 18D:
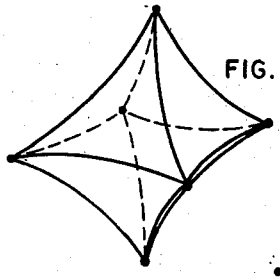
Figure 18E:
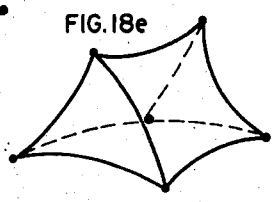
Figure 18G:
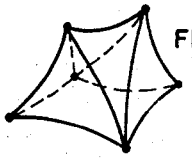
Figure 18H:
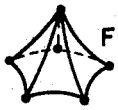
Figure 18F:
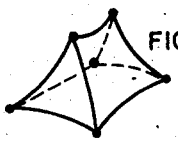
Figure 18I:
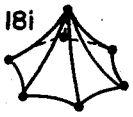
Figure 18J:
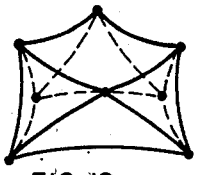
Figure 18K:
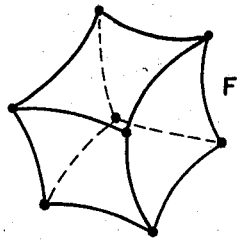
Figure 18M:
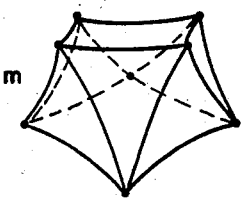
Figure 18N:
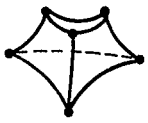
Figure 18O:
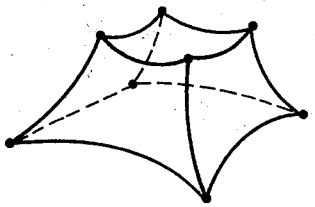
Figure 18P:
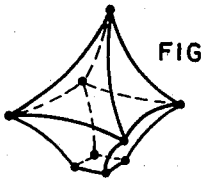
Figure 19A:
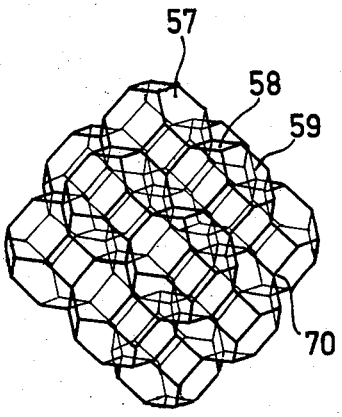
Figure 19B:
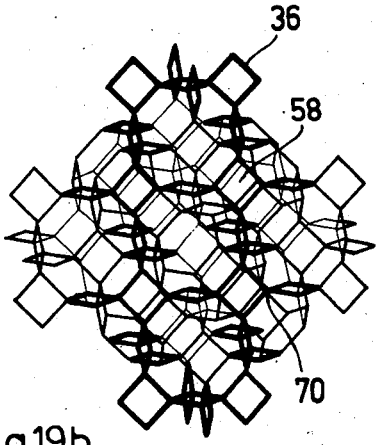

FIG. 18, consisting of FIGS. 18*a* to 18*p* illustrate various polyhedral shapes for an outer net of a spatial network according to the present invention;

FIG. 19*a* is a schematic, isometric representation of one form of inner net for a spatial network according to the present invention;

FIG. 19*b* illustrates one possible way of constructing the inner net of FIG. 19*a;*

Figure 19C:
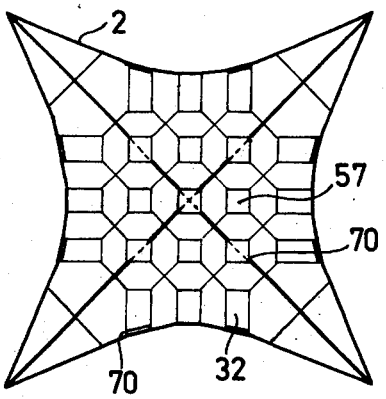

FIG. 19*c* is a cross-section through the inner net shown in FIG. 19*a;*

Figure 19D:
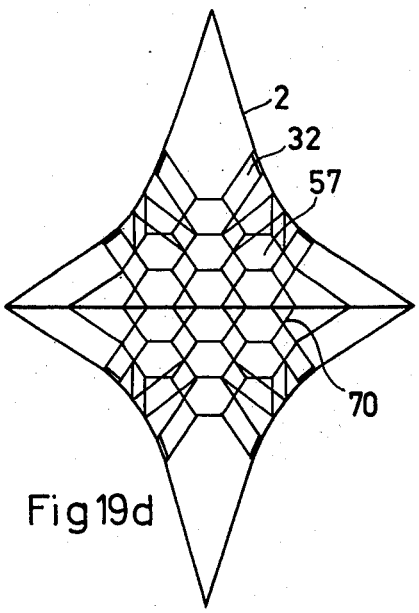

FIG. 19*d* is also a cross-section through the inner net of FIG. 19*a;*

Figure 20A:
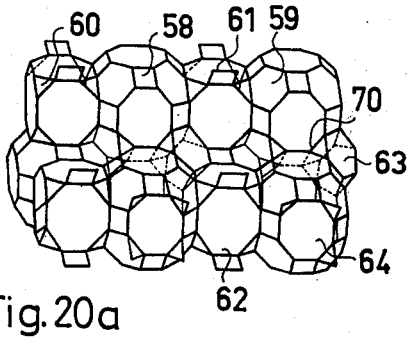
Figure 20B:
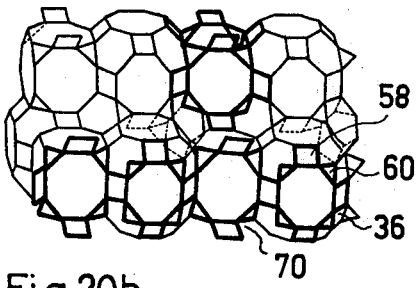
Figure 21A:
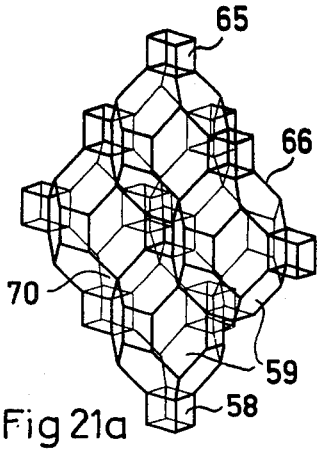
Figure 21B:
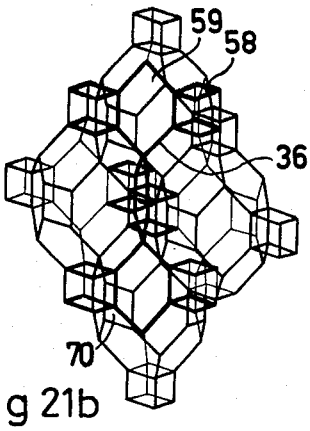

FIGS. 20*a* and 20*b* show another form of an inner net for a spatial network according to the present invention;

FIG. 21*a* shows part of a further form of an inner net for a spatial network according to the present invention;

FIG. 21*b* illustrates one possible method of construction of the inner net shown in FIG. 12*a;*

Figure 22A:
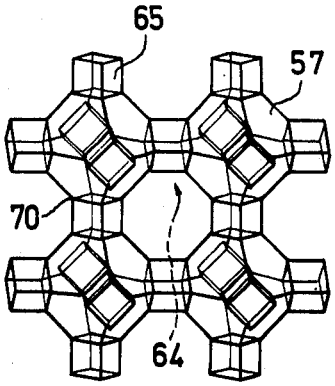
Figure 22B:
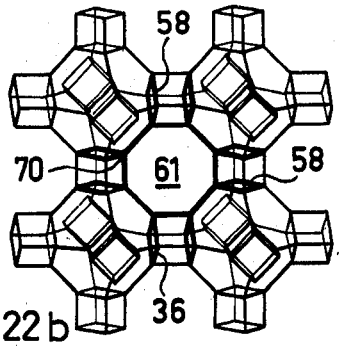

FIG. 22*a* illustrates another form of inner net for a spatial network according to the present invention;

FIG. 22*b* shows one possible method of construction of the inner net shown in FIG. 22*a;*

Figure 23A:
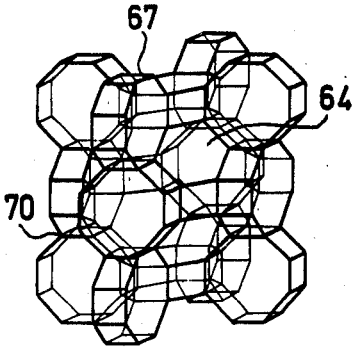
Figure 23B:
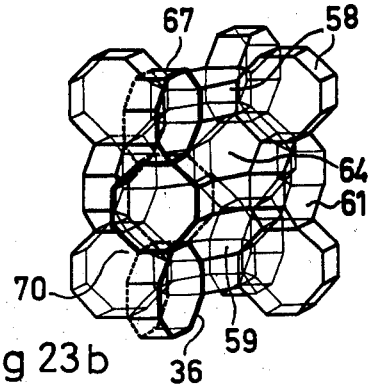

FIG. 23*a* shows part of another form of inner net for a spatial network according to the present invention;

FIG. 23*b* shows one possible method of construction of the inner net shown in FIG. 23*a;*

Figure 24A:
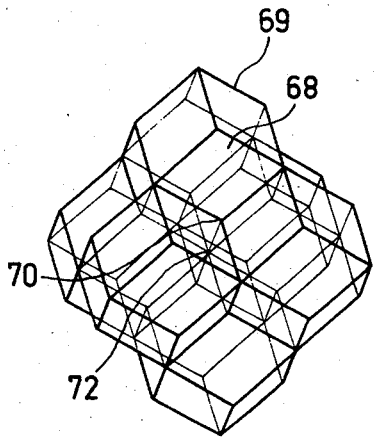
Figure 24B:
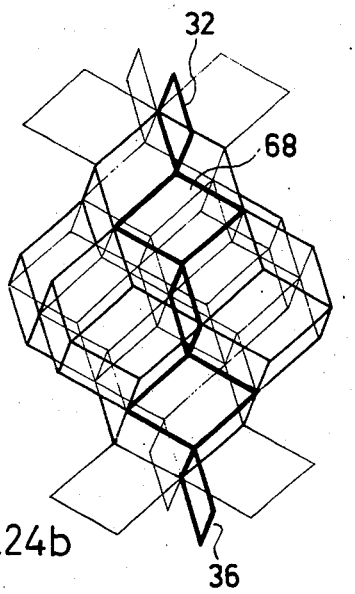

FIG. 24*a* shows another form of an inner net for a spatial network according to the present invention;

FIG. 24*b* shows one possible method of construction of the inner net shown in FIG. 24*a;*

Figure 25A:
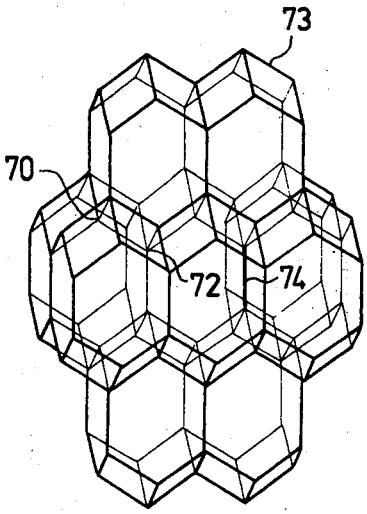
Figure 25B:
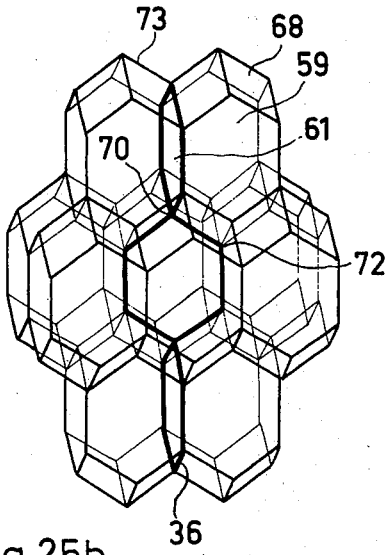

FIG. 25*a* shows another form of inner net for a spatial network according to the present invention;

FIG. 25*b* shows one possible method of construction of the inner net shown in FIG. 25*a;*

Figure 26A:
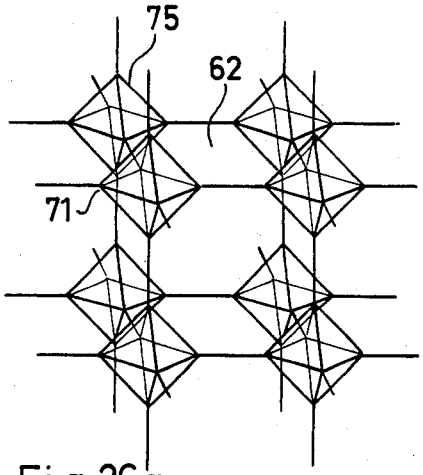
Figure 26B:
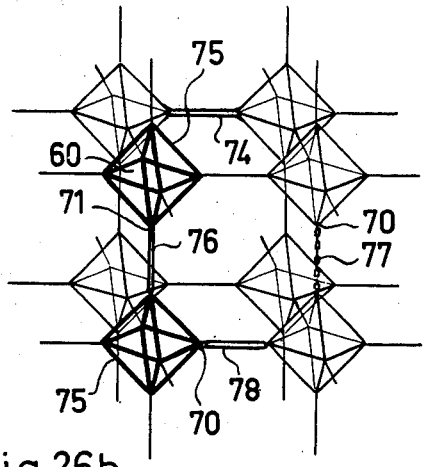

FIG. 26*a* shows part of another form of inner net for a spatial network according to the present invention;

FIG. 26*b* shows one method of construction of the inner net shown in FIG. 26*a;*

Figure 27A:
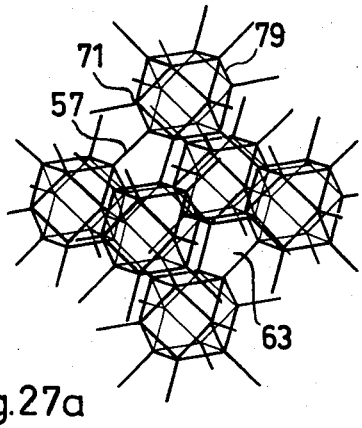
Figure 27B:
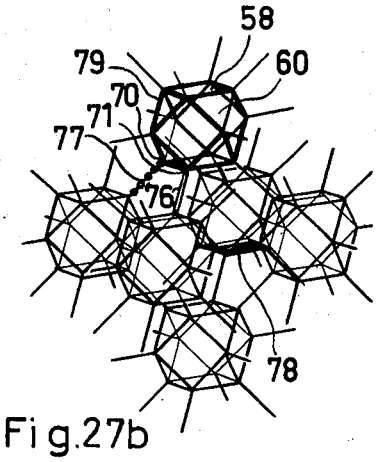

FIG. 27*a* shows part of another form of inner net for a spatial network according to the present invention;

FIG. 27*b* shows one possible method of construction of the inner net shown in FIG. 27*a;*

Figure 28A:
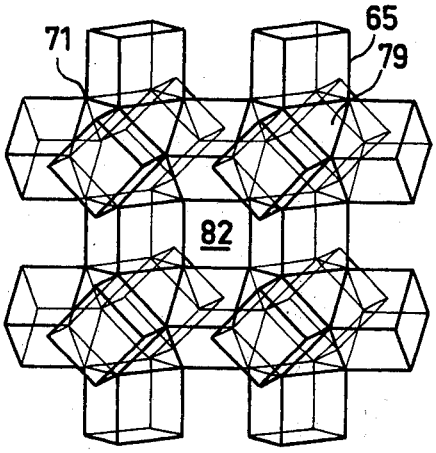
Figure 28B:
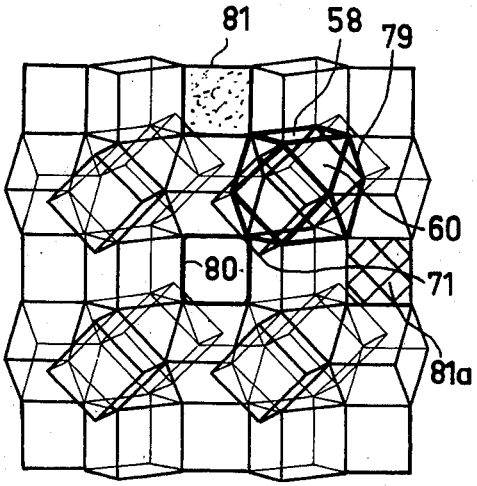

FIG. 28*a* shows another form of inner net for a spatial network according to the present invention;

FIG. 28*b* shows one possible method of construction of the inner net shown in FIG. 28*a;*

Figure 29A:
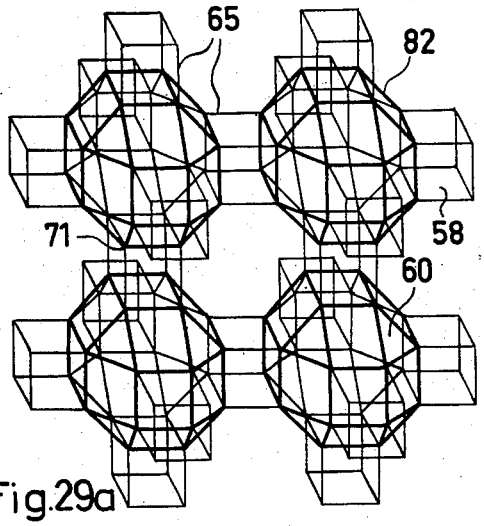
Figure 29B:
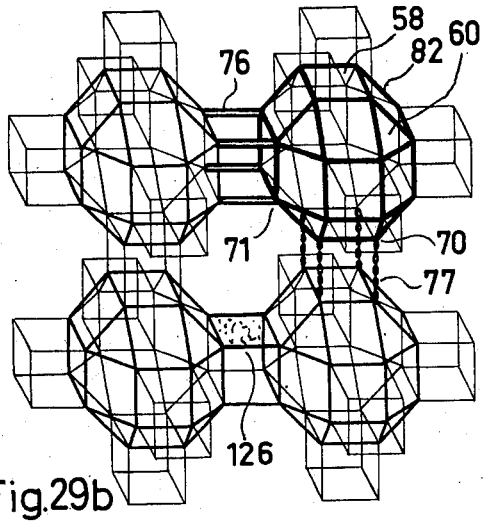

FIG. 29*a* shows another form of inner net for a spatial network according to the present invention;

FIG. 29*b* shows one possible method of construction of the inner net shown in FIG. 29*a;*

Figure 30A:
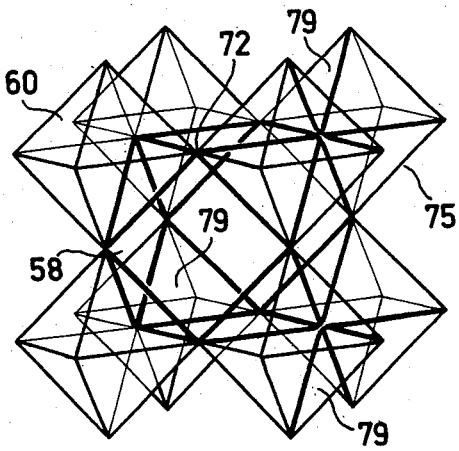
Figure 30B:
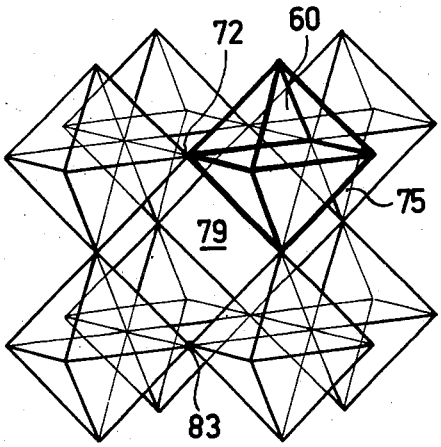

FIG. 30*a* shows part of another form of inner net for a spatial network according to the present invention;

FIG. 30*b* show one possible method of construction of the inner net shown in FIG. 30*a;*

Figure 31A:
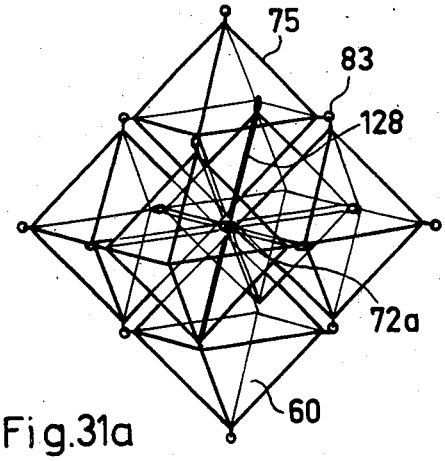
Figure 31B:
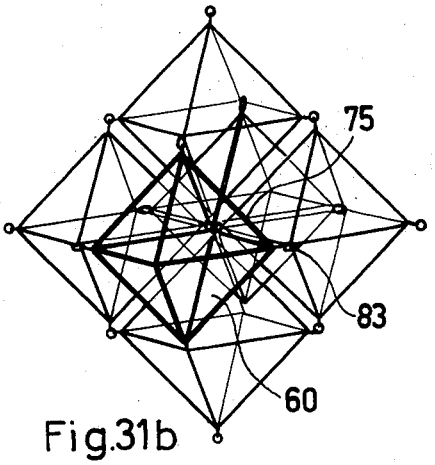

FIG. 31*a* shows another form of inner net for a spatial network in accordance with the present invention;

FIG. 31*b* shows one possible method of construction of the inner net shown in FIG. 31*a;*

Figure 32A:
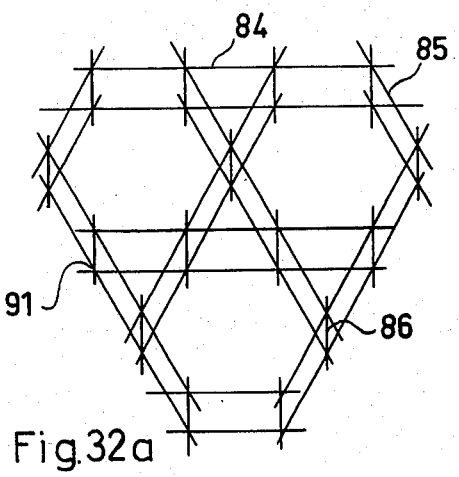
Figure 32B:
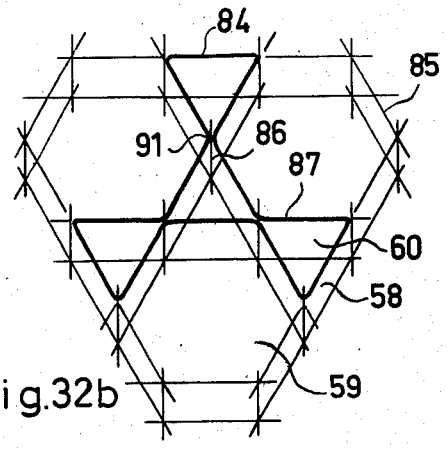

FIG. 32*a* shows schematically another form of inner net for a spatial network according to the present invention;

FIG. 32*b* shows one possible method of construction of the inner net shown in FIG. 32*a;*

Figure 33A:
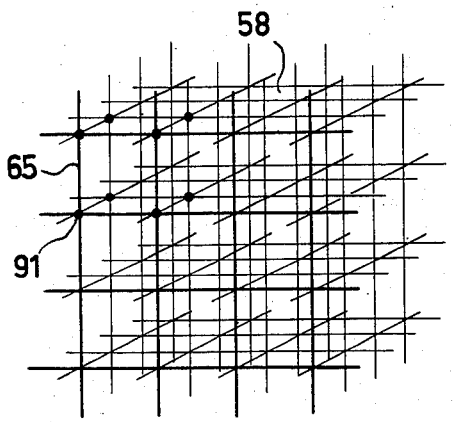
Figure 33B:
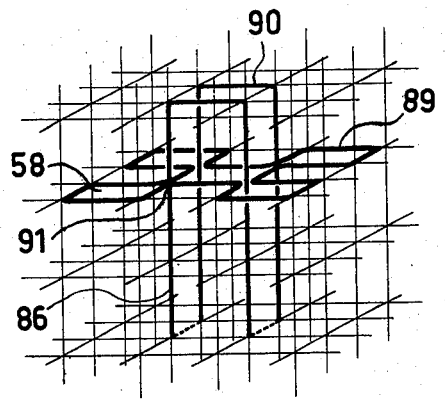

FIG. 33*a* shows schematically another form of inner net for a spatial network in accordance with the present invention;

FIG. 33*b* shows one possible method of constrction of the inner net shown in FIG. 33*a;*

Figure 34A:
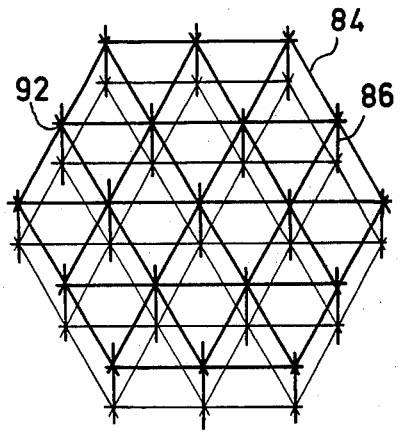
Figure 34B:
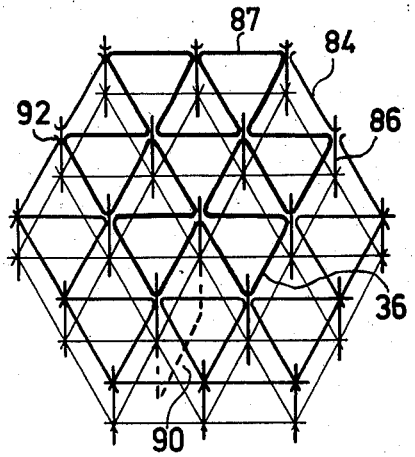

FIG. 34*a* shows schematically another form of inner net for a spatial network in accordance with the present invention;

FIG. 34*b* shows one possible method of construction of the inner net shown in FIG. 34*a;*

Figure 35A:
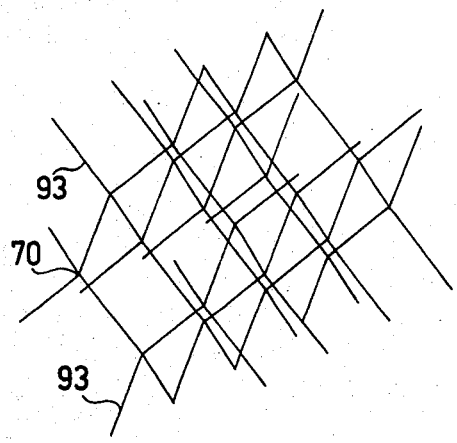
Figure 35B:
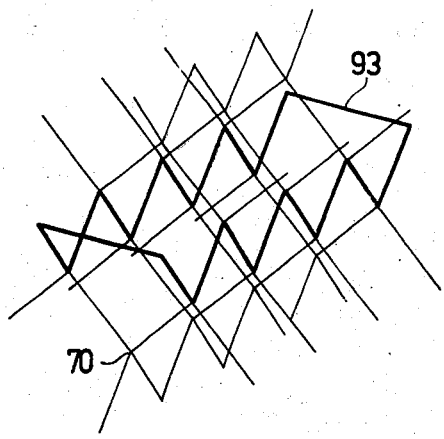

FIG. 35*a* shows schematically a part of another form of inner net for a spatial network in accordance with the present invention;

FIG. 35*b* shows one possible method of construction of the inner net shown in FIG. 35*a;*

Figure 36A:
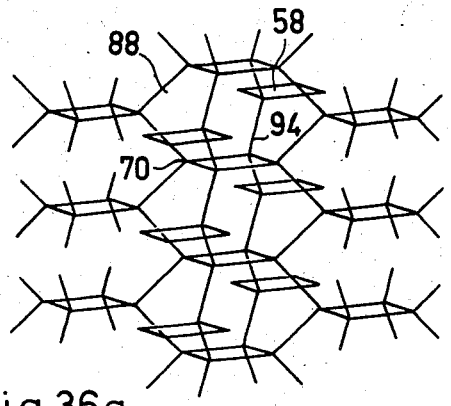
Figure 36B:
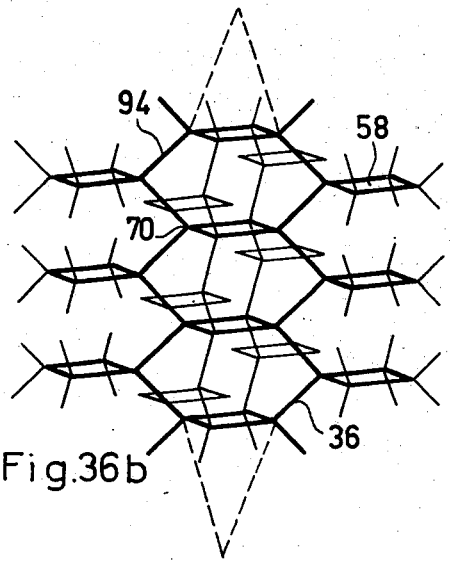

FIG. 36*a* shows part of another form of inner net for a spatial network according to the present invention;

FIG. 36*b* shows one possible method of construction of the inner net shown in FIG. 36*a;*

Figure 37A:
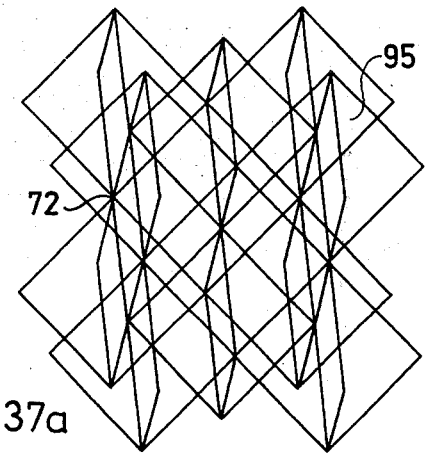
Figure 37B:
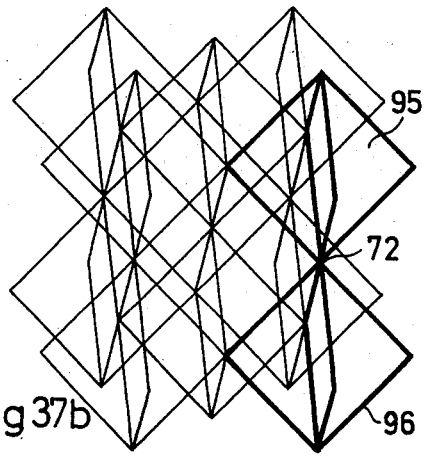

FIG. 37*a* shows a further form of inner net for a spatial network according to the present invention;

FIG. 37*b* shows one possible method of construction of the inner net shown in FIG. 37*a;*

Figure 38:
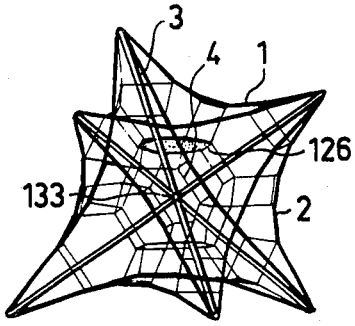
Figure 39:
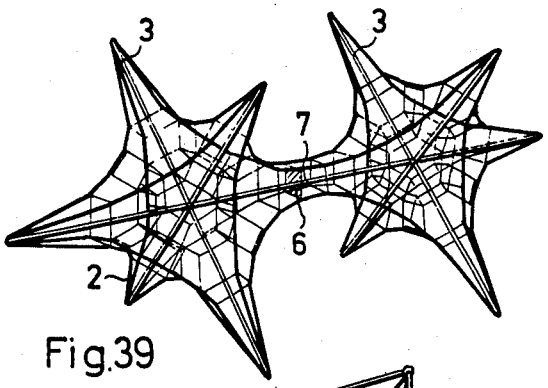
Figure 40:
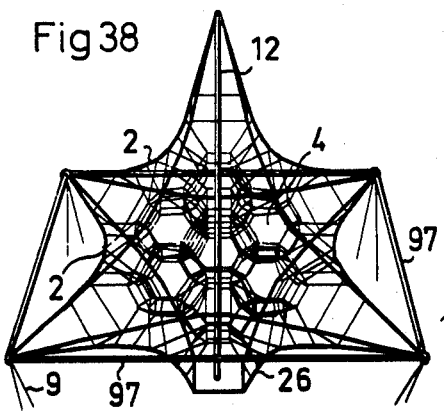
Figure 41:
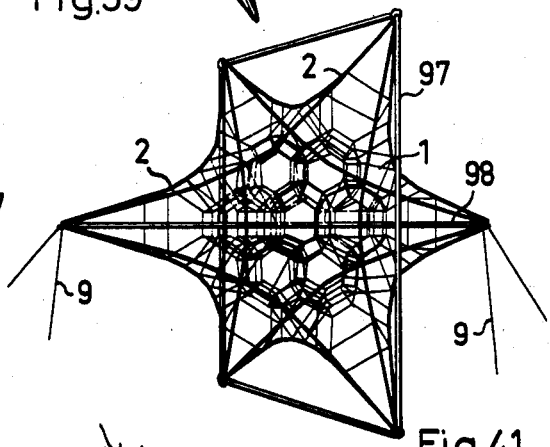
Figure 42:
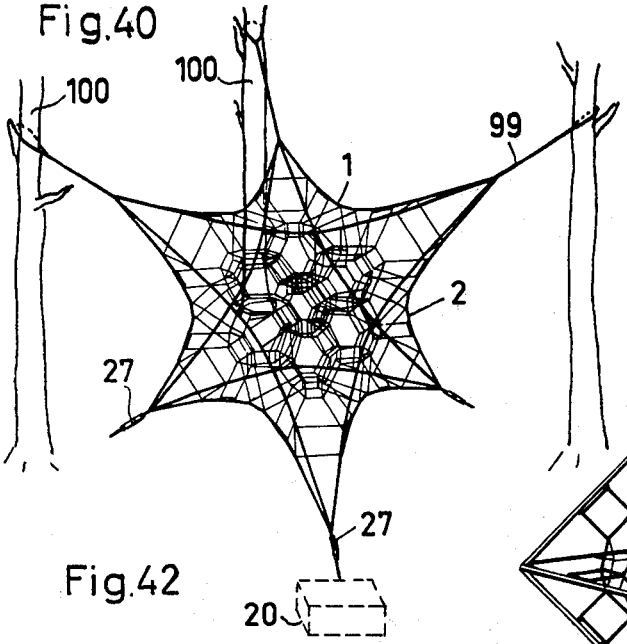
Figure 43:
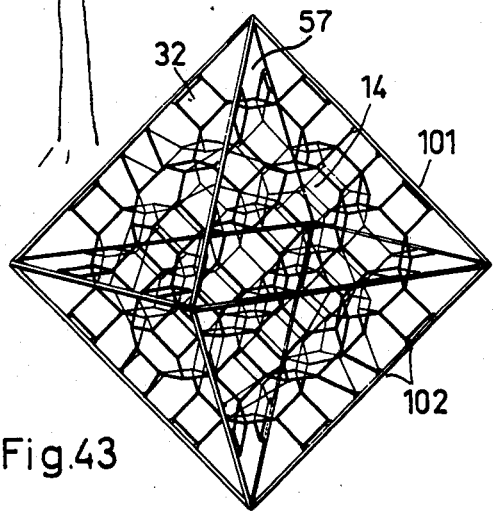
Figure 44:
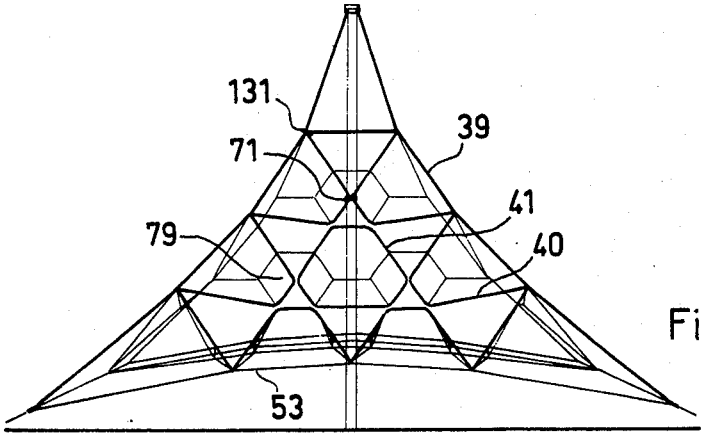
Figure 45:
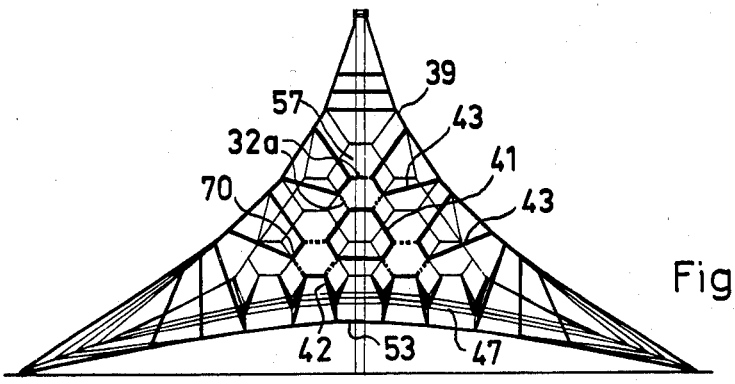
Figure 46:
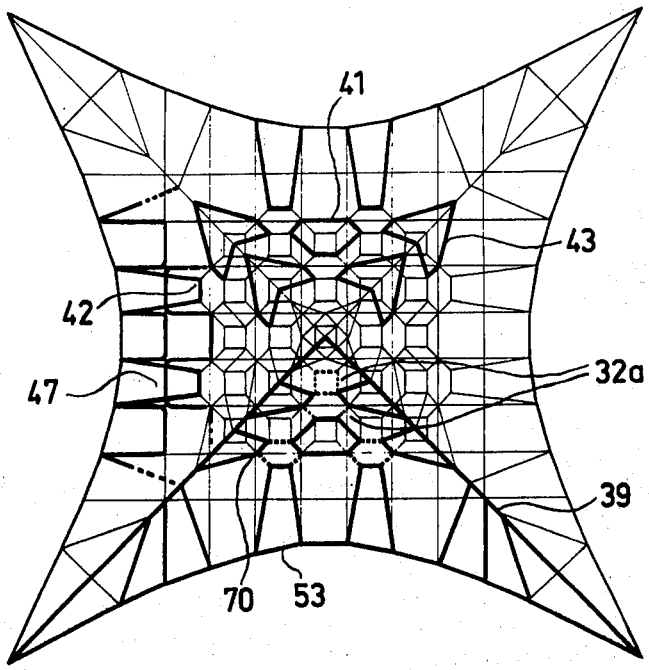
Figure 47:
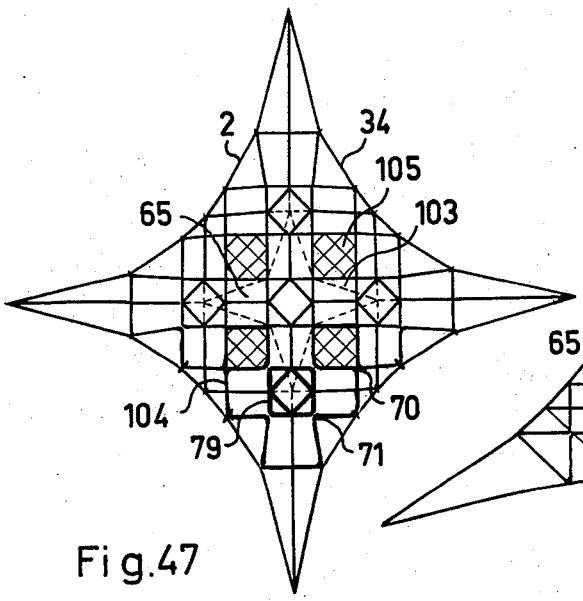
Figure 48:
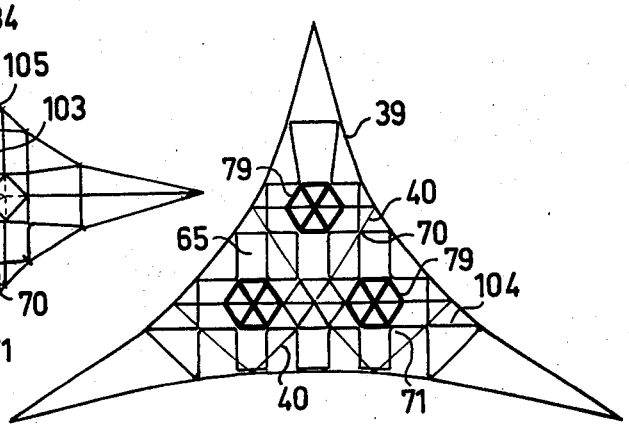
Figure 49:
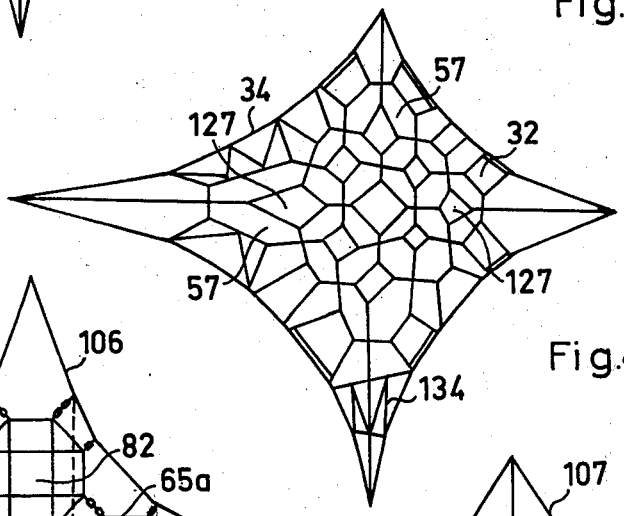
Figure 50:
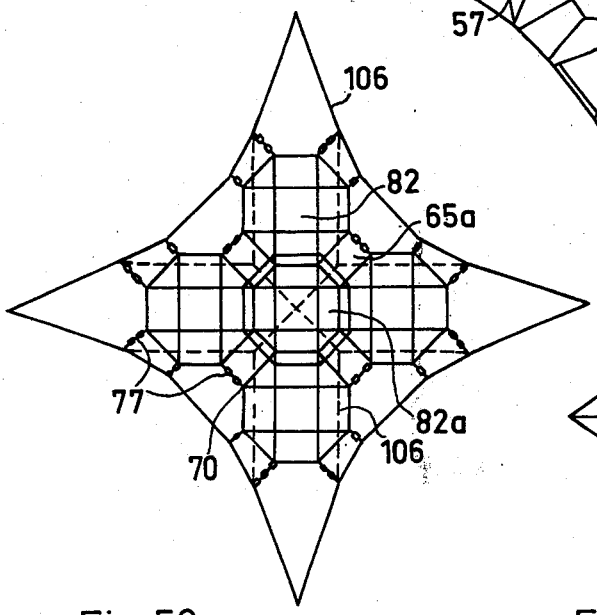
Figure 51:
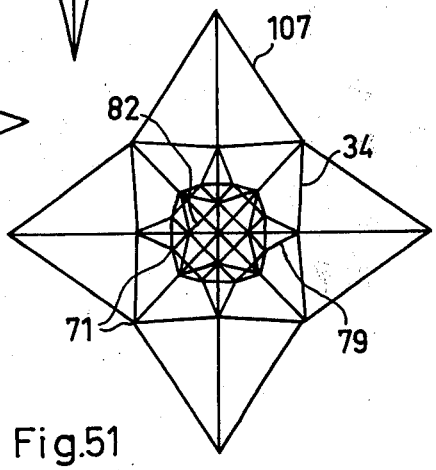
Figure 52:
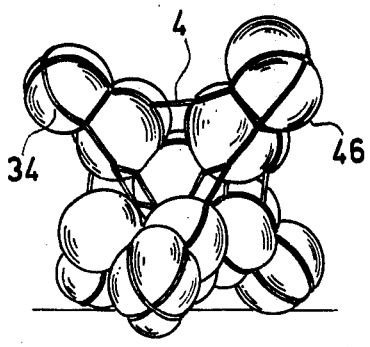
Figure 53:
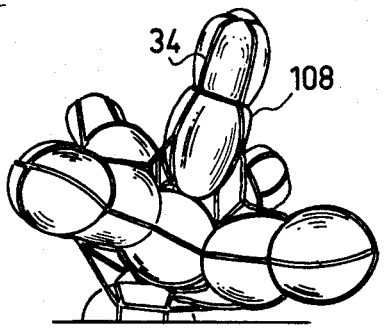
Figure 54A:
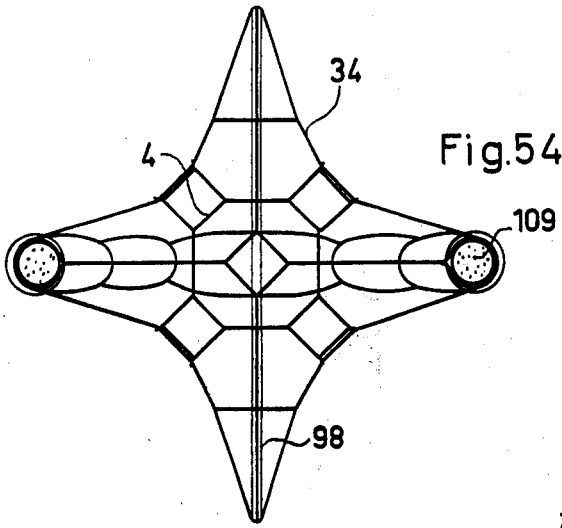
Figure 54B:
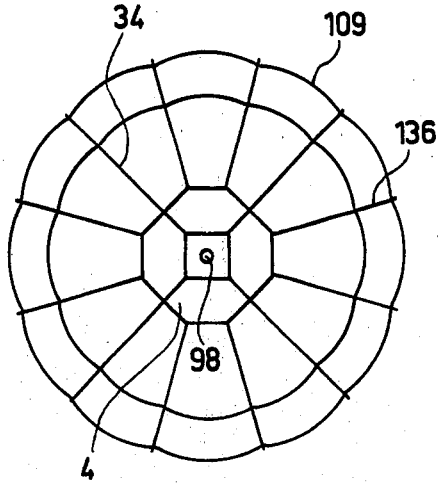
Figure 55A:
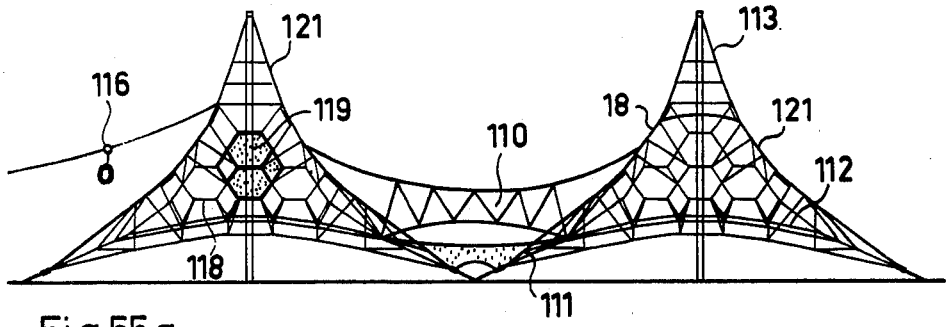
Figure 55B:
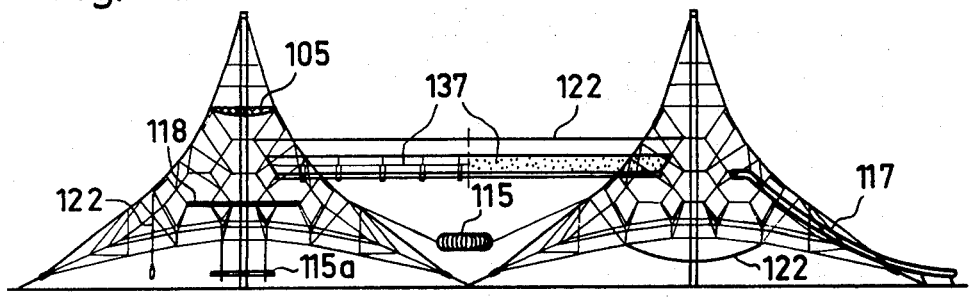
Figure 56:
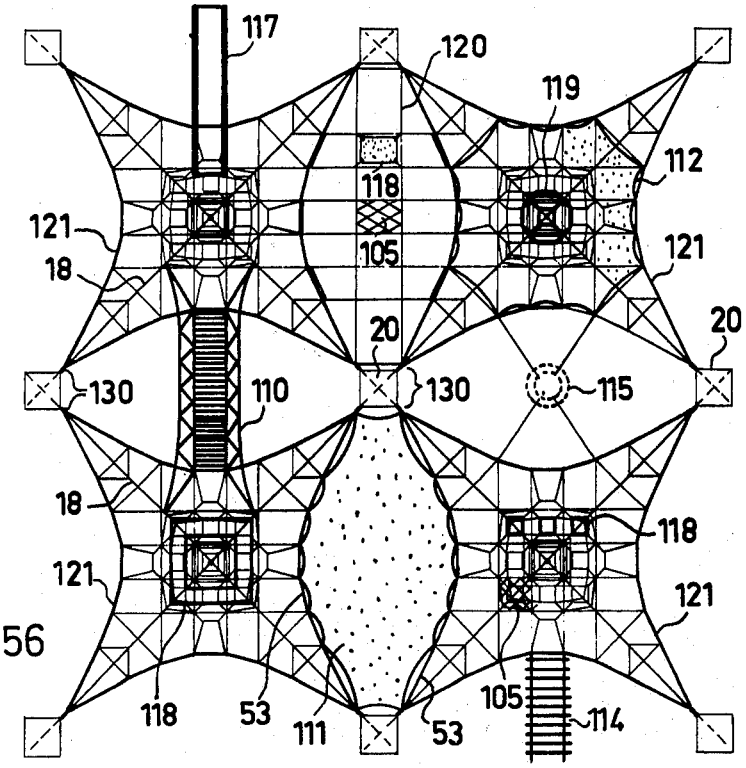

FIG. 38 shows a perspective of further embodiment of a spatial network in accordance with the present invention;

FIG. 39 shows in perspective another embodiment of a spatial network in accordance with the present invention;

FIG. 40 is a perspective view of another spatial network in accordance with the present invention;

FIG. 41 is a development of the spatial network shown in FIG. 40;

FIG. 42 is a perspective view of a further embodiment of a spatial network in accordance with the present invention;

FIG. 43 shows a perspective view of another embodiment of a spatial network in accordance with the present invention;

FIG. 44 is a side view of part of a further embodiment of a spatial network in accordance with the present invention;

FIG. 45 is a side view of part of a further embodiment of a spatial network in accordance with the present invention;

FIG. 46 is a plan view of a spatial network as shown in FIG. 45;

FIG. 47 shows, in cross-section, a further embodiment of a spatial network in accordance with the present invention;

FIG. 48 is a vertical section through a further embodiment of a spatial network in accordance with the present invention;

FIG. 49 is a cross-section or plan view of another embodiment of a spatial network in accordance with the present invention;

FIG. 50 shows another embodiment of a spatial network in accordance with the present invention;

FIG. 51 is a plan view of a further embodiment of a spatial network in accordance with the present invention;

FIG. 52 shows in perspective, a further embodiment of a spatial network in accordance with the present invention;

FIG. 53 is a perspective view of a further spatial network in accordance with the present invention;

FIGS. 54*a* and 54*b* show a further embodiment of a spatial network according to the present invention;

FIGS. 55*a* and 55*b* show further spatial networks according to the present invention;

FIG. 56 shows another spatial network according to the present invention;

FIGS. 57*a* to 57*d* show, in perspective, connecting elements for spatial networks, in accordance with the present invention; and FIGS. 58*a* to 58*k* illustrate connections between ropes of spatial networks in accordance with the present invention.

Figure 59:
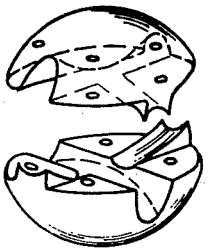
Figure 1:
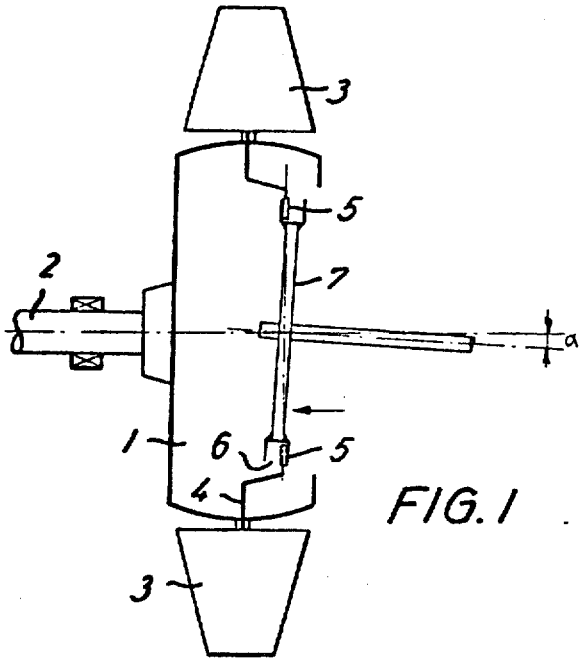
Figure 2:
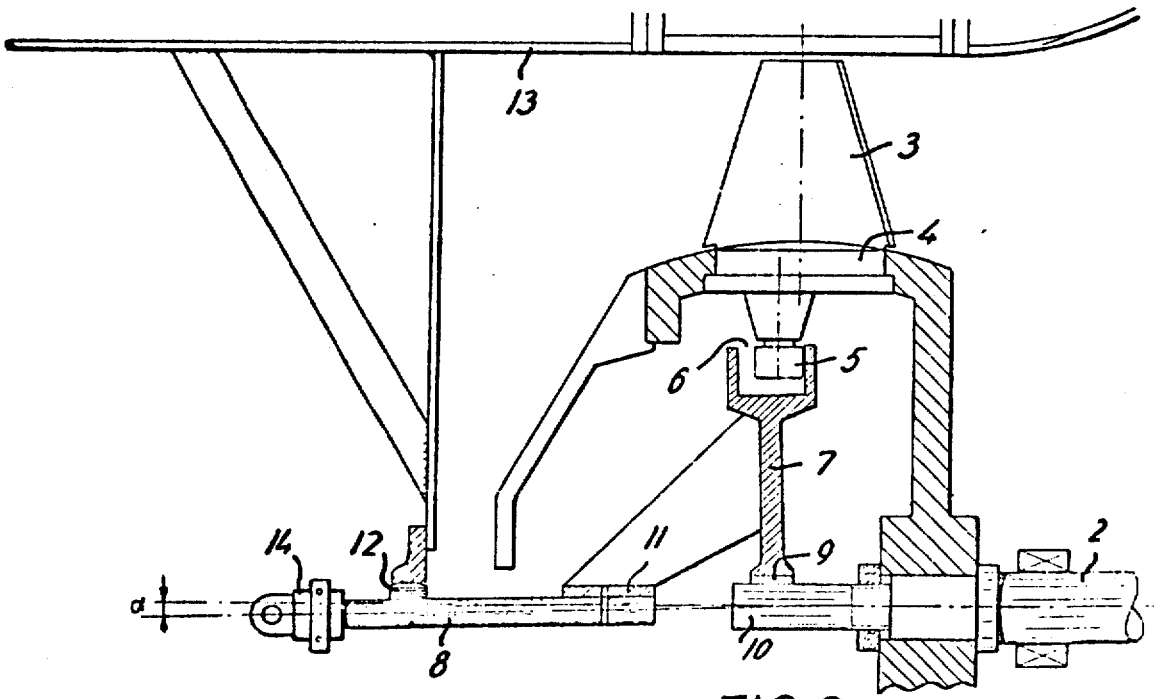

FIG. 59 illustrates a connector for two ropes of spatial networks in accordance with the present invention.

Throughout the drawings like parts have been designated by the same reference numerals.

Figure 1:
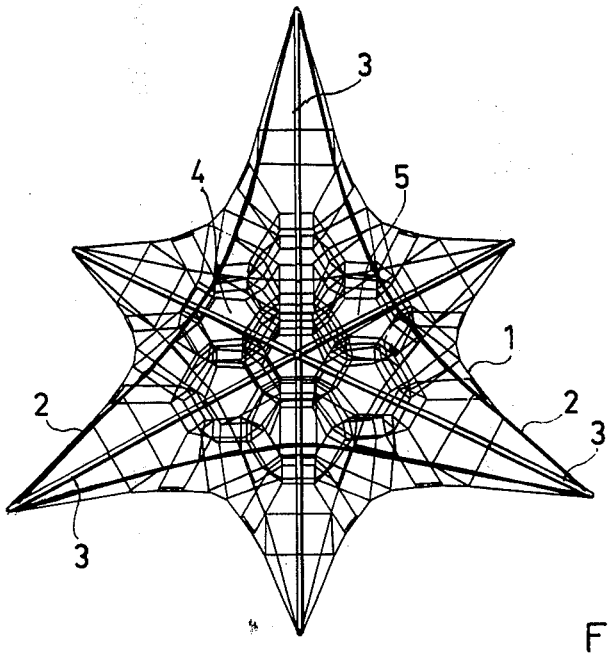
FIG. 1 is a plan view of a first embodiment of a spatial network in accordance with the present invention.

FIG. 1 is a plan view of a first embodiment of a spatial network in accordance with the present invention consisting of an outer net 1 in the form of an octahedron, the peripheral ropes 2 of which are held taut with the aid of three mutually intersecting compression members 3. The compression members 3 pass through the interior of an inner net 4 arranged inside the outer net 1, the inner net 4 being built up from individual polyhedra 5.

Figure 2:
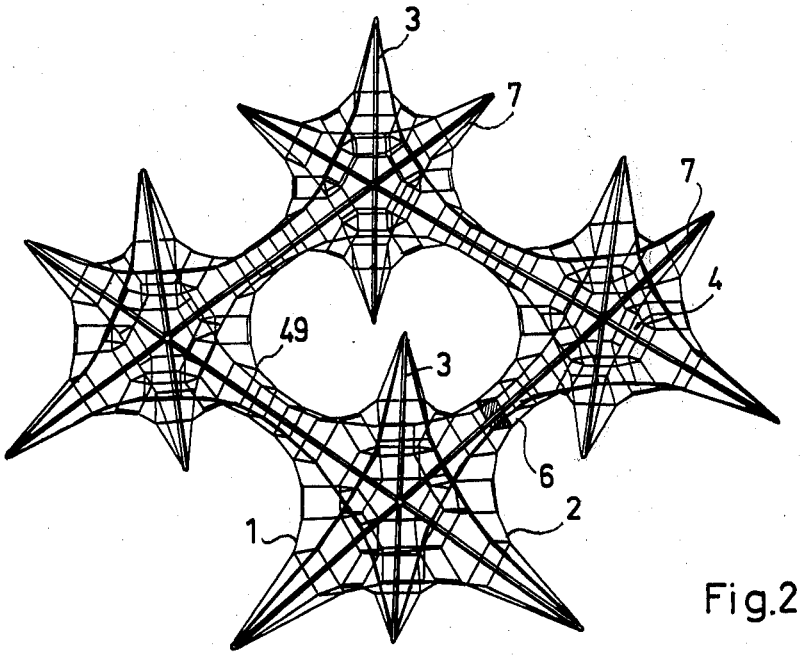
FIG. 2 shows, in perspective, a development of the spatial network of FIG. 1.

FIG. 2 shows a development of the spatial network illustrated in FIG. 1 consisting of four outer nets 1 which are connected to one another. Each connection is made in the region of the vertices of two adjacent outer nets, a widening of the outer net being effected in the region of these vertices. Thus, one vertex of each outer net is truncated to form a respective imaginary plane 6 which is square in plan, the square planes of adjacent outer nets being connected together. An extended compression member 7 passes through each of these planes 6, the compression member 7 being elongations of each compression member 3.

Figure 3:
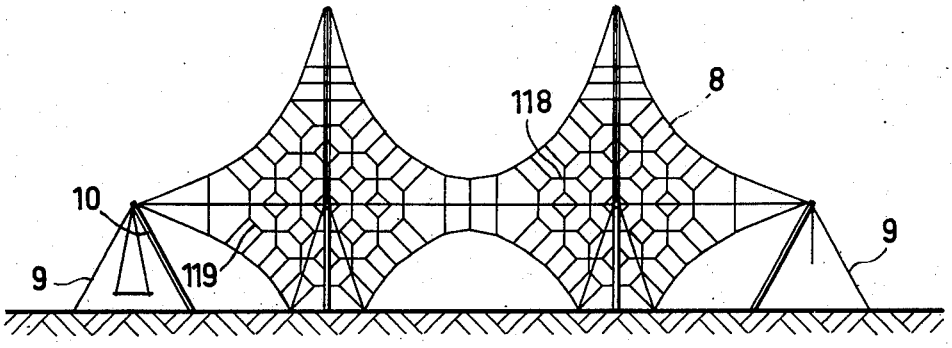
FIG. 3 is a side view of a second embodiment of a spatial network in accordance with the present invention.
Figure 4:
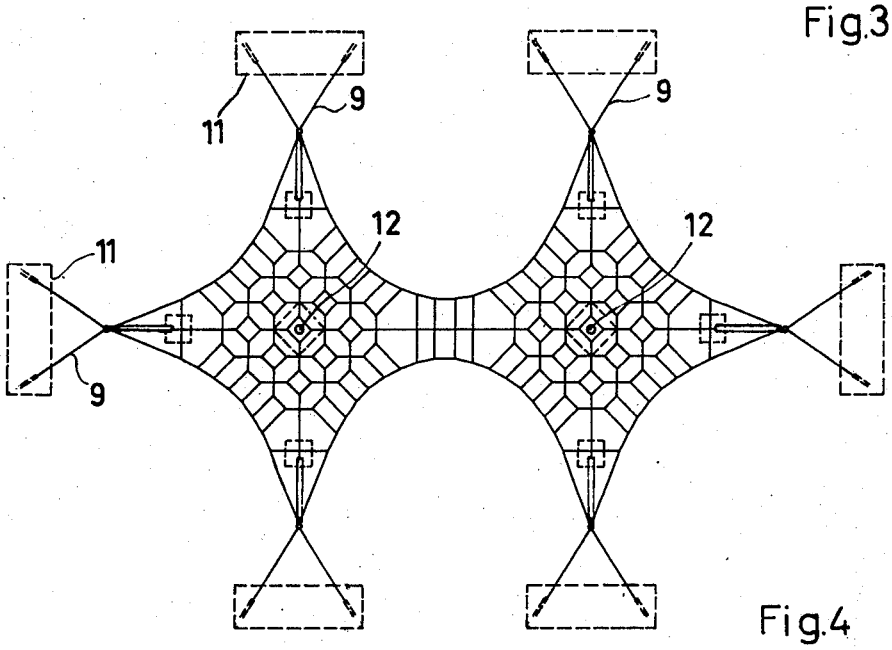
FIG. 4 is a plan view of the spatial network shown in FIG. 3.
Figure 5:
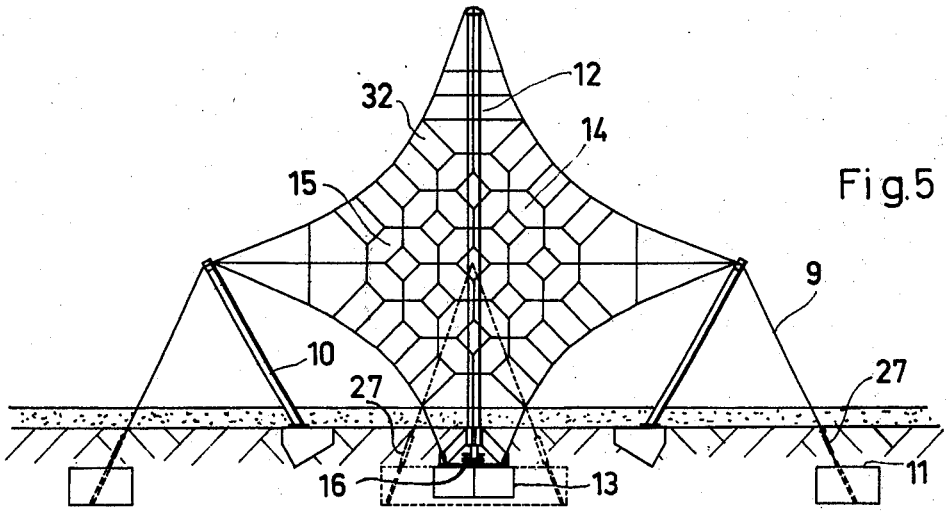
FIG. 5 is a front elevational view of the spatial network shown in FIG. 3.

FIGS. 3 to 5 show a second embodiment of a spatial network in accordance with the present invention comprising three outer nets 8 each in the form of a truncated octahedron, the three outer nets being arranged linearly in side by side relationship. In this embodiment the laterally projecting corners of the spatial network are supported using tensioning ropes 9 which pass over respective compression members 10 disposed at an angle to the vertical. The ends of the tensioning ropes 9 are anchored in concrete blocks 11 resting on or buried in the ground. The uppermost vertex of each outer network is supported by the upper end of a vertical compression member 12 the lower end of which is anchored in a lower abutment 13 to which the lowermost vertex of the respective outer net 8 is also anchored. The compression members 12 pass through a three-dimensional inner net 14 built up from individual polyhedra 15. To achieve an improved stability of the compression members 12, tensioning ropes 16 are provided, these tensioning ropes also being secured to the abutment 13.

Figure 6:
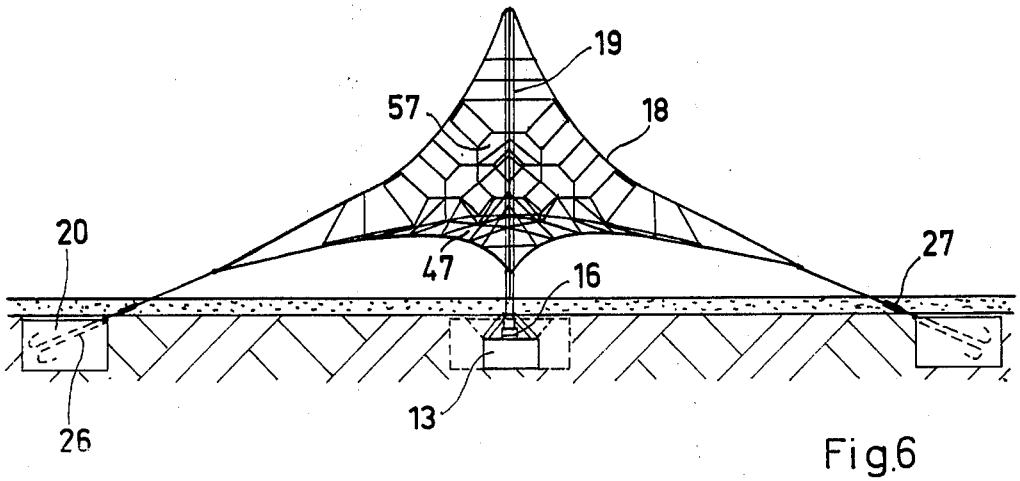
FIG. 6 is a side view of a third embodiment of a spatial network in accordance with the present invention.
Figure 7:
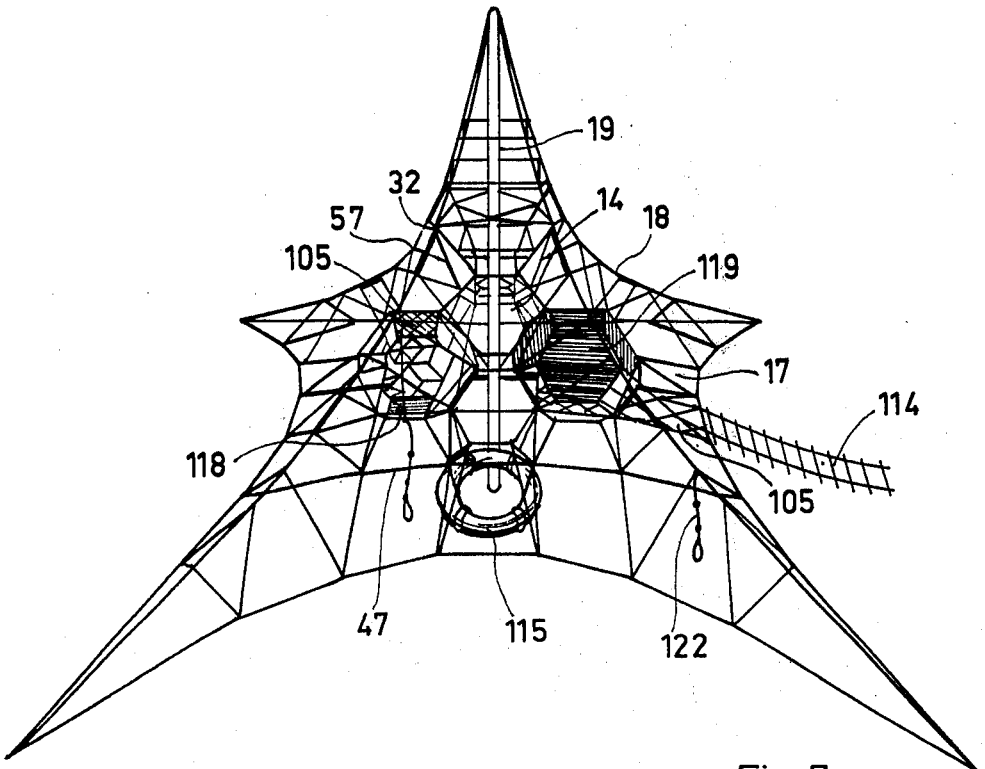
FIG. 7 is a perspective view of a spatial network of FIG. 6.

FIGS. 6 and 7 show a third embodiment of a spatial network in accordance with the present invention. This spatial network comprises a hemioctahedron outer net 17 formed by polygonally curved peripheral ropes 18. An inner net 14 built up from truncated octahedra 57 is mounted within the outer net 17. The inner net 14 is anchored at its edges to the inclined peripheral ropes 18 by means of loop like extensions 32, whilst at its lowermost end, the inner net is anchored to lower tensioning rope net 47. The peripheral ropes 18 are suspended at the uppermost vertex of the outer net by an inner compression member 19 and are anchored in concrete blocks 20 disposed on or buried in the ground. The peripheral ropes 18 include tensioning devices 27 and anchoring yokes 26. The compression member 19 is pivotally mounted on an adjustable base plate 16' which is supported on the abutment 13. Further interior components are inserted in the inner net 14 to enable the spatial network to be used as a play appliance for children. For example, the inner net 14 may be provided with small narrow-meshed rope nets 105 each of which is planar in form, further vertical ropes 122 for swinging to and fro upon and for horizontal movement exercises, surfaces of wood or plastics material 118 for sitting upon, small cabins 119 made of panel material, a rope ladder 114 secured to the horizontal peripheral rope 18, etc.

Figure 8:
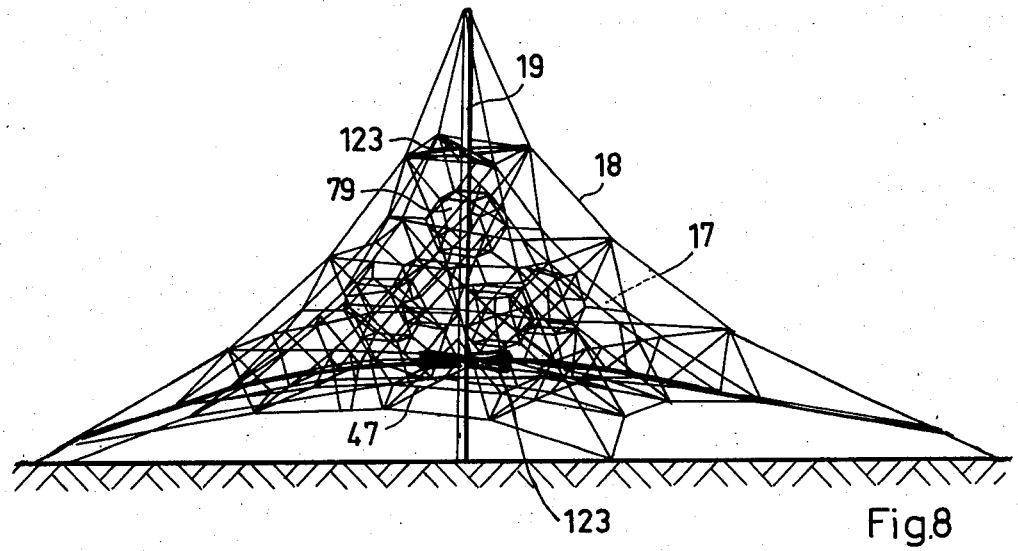
FIG. 8 is a perspective view of a fourth embodiment of a spatial network in accordance with the present invention.
Figure 9:
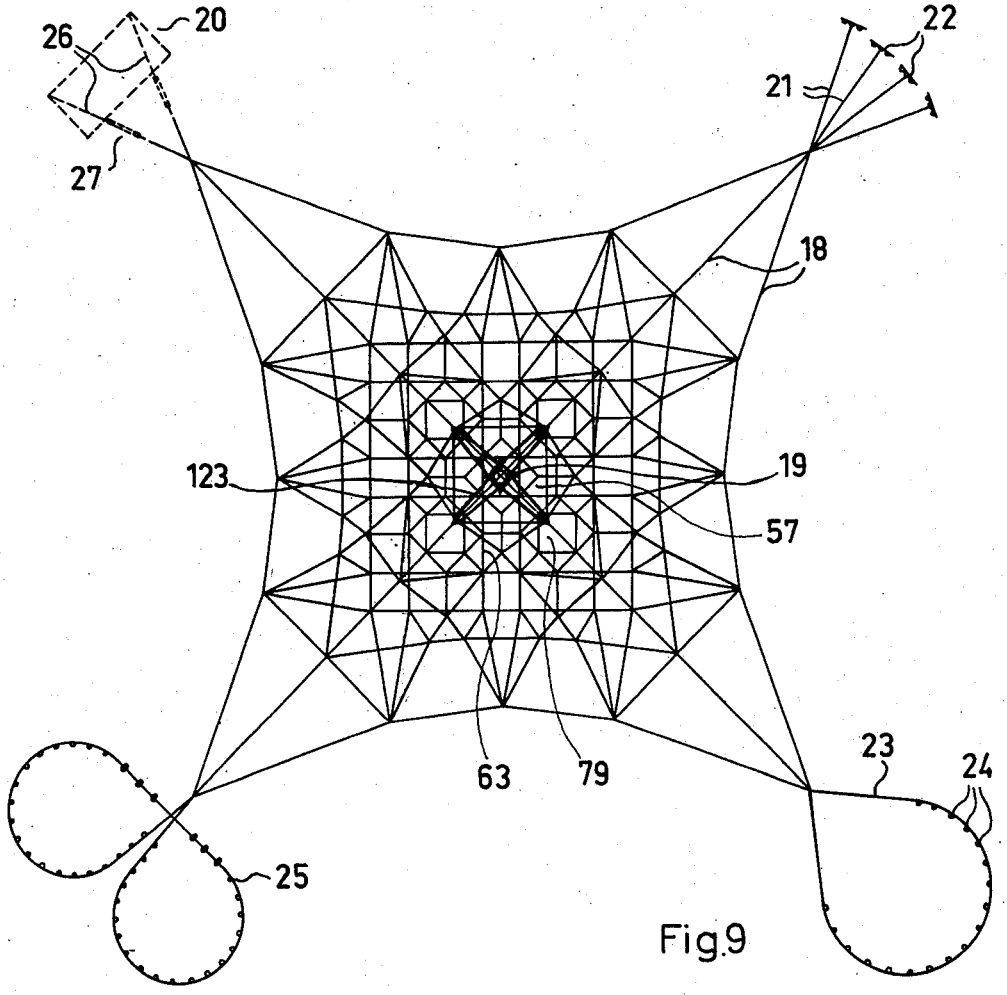
FIG. 9 is a plan view of a spatial network as shown in FIG. 8.

FIGS. 8 and 9 illustrate a further embodiment of a spatial network according to the present invention and comprising a hemioctahedral outer net 17 and an inner net built up from cub-octahedra 79 each of which is made from a single rope, truncated octahedra 57 and truncated tetrahedra 63. The peripheral ropes 18 of the outer net 17 lead from a single inner compression member 19 which is resiliently supported intermediate its ends by means of star-shaped rope rings 123 and, as a result, is of very slender construction. The lateral anchoring of the peripheral ropes 18 is effected either with the aid of the concrete blocks 20 buried in the ground or with one or more anchoring ropes 21 emanating from a nodal point in a fan-shaped manner. In the latter case the anchoring ropes 21 are, in turn, embedded in the ground with the aid of stakes 22. Alternatively, the lateral anchoring can be effected by means of a loop 23 of rope, the internal edge of which is connected to a plurality of stakes 24 driven into the ground. As a further alternative a double loop 25 of rope may be provided for anchoring the spatial network to the ground in which case a plurality of stakes 26 are provided to anchor and retain the loop 25 of rope.

Figure 10:
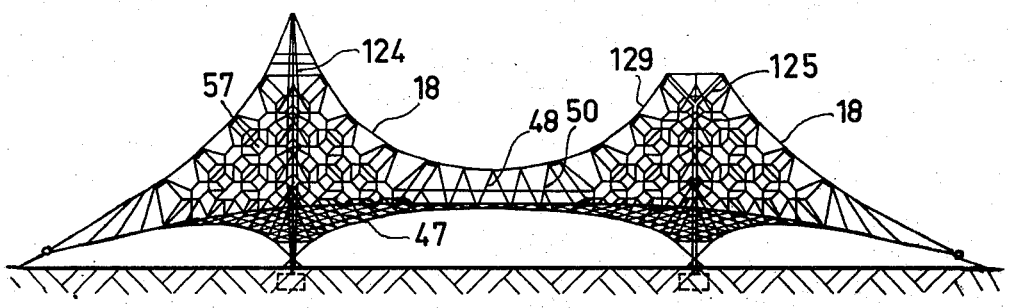
FIG. 10 is a side view of a fifth embodiment of a spatial network in accordance with the present invention.
Figure 11:
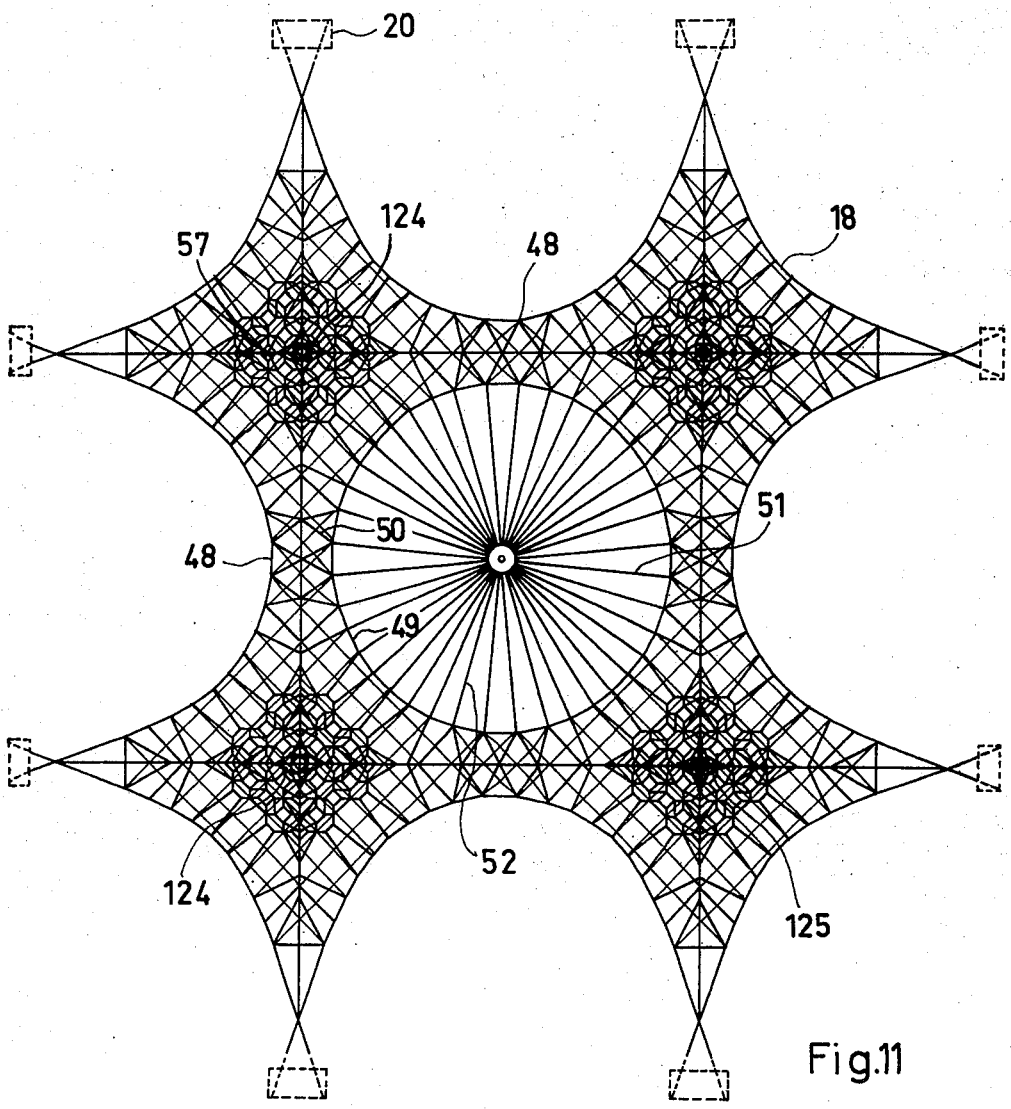
FIG. 11 is a plan view of a spatial network as shown in FIG. 10.

FIGS. 10 and 11 show a very large spatial network in accordance with the present invention. This spatial network comprises four outer nets 129 each of which is either in the form of a hemioctahedronor in the form of a truncated hemioctahedron. The outer nets are connected by means of bridge-like connecting parts 48 in such a way that an inner enclosure 51 is formed. A roof 52 may be stretched between an inner tensile ring 49 and the periphery of the inner enclosure 51. The peripheral ropes 18 of this spatial network are supported at their uppermost ends by a trussed compression member 124 or by a mast 125 having a forked upper end. At their lower ends, the peripheral ropes are anchored in concrete blocks 20. Within each outer net there is an inner net consisting of truncated octahedra 57, the inner net being anchored in a lower tensioning rope net 47 above ground.

FIGS. 12*a* and 12*b* show a very simple spatial network in accordance with the present invention consisting of an inner net built up from a truncated octahedron 63, supported from an outer net in the form of a tetrahedron 31 by means of rope loops 32. This spatial network also has simple rope rings 28 in the region of the vertices of the outer net. The inner net is made from a single long length of rope 36 the ends of which are connected by a pressed-on sleeve 35. The shape of the inner net is maintained by connecting members 54 so that the inner net consists of triangular meshes 30 and quadrilateral meshes 58. The connection between the inner net and the outer net is effected by means of S-shaped connecting elements 55 or by other rope clips.

FIG. 13*a*, 13*b*, 13*c* and 13*d* show a further spatial network in accordance with the present invention. In this embodiment an inner net consists of a truncated octahedron 57 which is supported by means of rope loops 32 from an outer net 34 made from a single rope. The inner net is built up from two smaller rope rings 29 and a larger longer rope ring 36 with a plurality of rope meshes 28. Only three sleeves 35 are provided for connecting the ends of the ropes of the entire inner net. Connecting members 54, preferably in the form of S-shaped hooks serve to connect the rope rings together while further S-shaped connecting elements 55 connect the rope rings with the outer net 34 via the rope loops 32.

FIG. 14*a* and FIG. 14*b* show the rope track of an octahedral rope ring 34 mde from a single rope the ends of which are joined by a sleeve 35 and whose shape is defined by connecting members 54.

FIGS. 15*a* and 15*b* show the rope track of a cub-octahedral rope ring 33 made from a single rope and FIG. 16 shows the same for a hemicuboctahedral rope ring.

FIG. 15*c* is a plan projection of a network consisting of five cuboctahedral rope rings formed from a single very long rope 36.

FIGS. 17*a* and 17*b* show the rope track of a rhombicuboctahedral rope ring 37 made from a single rope 36 and conprising six quadrilateral meshes 58 and eight triangular meshes 60.

FIGS. 18*a* to 18*p* show various polyhedra with curved edges which may be used for the outer net of a spatial network according to the present invention. The lines shown in these Figures represent the respective peripheral ropes. In detail, FIG. 18*a* illustrates a tetrahedron, FIG. 18*b* a hemioctahedron, FIG. 18*c* a hexadeltahedron, FIG. 18*d* an octahedron, FIG. 18*e* a triangular prism, FIG. 18*f* a pentahedronn with two trapezoidal surfaces, FIG. 18*g* a heptahedron, FIG. 18*h* a five-sided pyramid, FIG. 18*i* a hexagonal pyramid, FIG. 18*k* a hexahedron or rhombohedron, FIG. 18*l* a hemicuboctahedron, FIG. 18*m* a cubic prism, FIG. 18*n* a truncated tetrahedron, FIG. 18*o* a truncated hemioctahedron and FIG 18*p* a truncated octahedron.

The following FIGS. 19*a* to 37*b* illustrate various spatial configurations for an inner net of a spatial network according to the present invention.

FIGS. 19*a* and 19*b* show a spatial configuration for the inner net consisting of truncated octahedra 57 with quadrilateral meshes 58 and hexagonal meshes 59, the latter resulting from the boundaries between the quadrilateral meshes 58. This spatial configuration is formed from a long rope 36 and is interlinked in chain form with the quadrilateral meshes 58, there being only two ropes at each nodal point 70.

FIGS. 19*c* and 19*d* show a spatial configuration for the inner net consisting of truncated polyhedra 57 anchored in an outer net which is octahedral in form with polygonally curved peripheral ropes 2. In this embodiment rope loops 32 effect the connection between the inner net and the outer net as a result of which only two ropes exist at each nodal point 70.

FIGS. 20*a* and 20*b* illustrate a spatial configuration for the inner net consisting of truncated cubes 66, truncated tetrahedra 63 and truncated cuboctahedra 64, and includes triangular meshes 60, quadrilateral meshes 58, hexagonal meshes 59 and octagonal meshes 61. This inner net is formed from very long ropes 36 with triangular meshes 60 and quadrilateral meshes 58 which are interlinked in chain form there being only two ropes at each nodal point 70.

FIGS. 21*a* and 21*b* show a spatial configuration for the inner net consisting of cubes 65 and truncated cubes 66 i.e. polyhedra with eighteen faces, and this is formed from very long rope rings 36 with quadrilateral meshes 58 and hexagonal meshes 59 and again displsys nodal points at which only two ropes are present.

FIGS. 22*a* and 22*b* show a spatial configuration for the inner net consisting of truncated octahedra 57, cubes 65 and truncated cuboctahedra 64 and this inner net again is fashioned from very long rope rings 36 with quadrilteral meshes 58 and octagonal meshes 61, there being only two ropes at each nodal point 70.

FIGS. 23*a* and 23*b* show a spatial configuration for the inner net consisting of octagonal prisms 67 and truncated cuboctahedra 64. This inner net again is fashioned from very long rope rings 36 with octagonal meshes 61 interlinked in chain form. Only two ropes are present at each nodal point 70.

FIGS 24*a* and 24*b* show a spatial configuration for the inner net consisting of dodecahedra 69 which are fashioned from very long rope rings 36 with rhombic or quadrilateral meshes 68 interlinked in chain form. This inner net is such that there are two ropes at each nodal point 70 and four ropes at each nodal point 72.

FIGS. 25*a* and 25*b* show a spatial configuration for the inner net consisting of hexagonal-rhombic dodecahedra 73 and this inner net is fashioned from very long rope rings 36 with hexagonal meshes 61 interlinked in chain form. This inner net displays two ropes at each nodal point 70, four ropes at each nodal point 72 and four ropes at point 74.

FIGS. 26*a* and 26*b* show a spatial configuration for the inner net consisting of octahedra 75 and truncated cubes 62. This inner net is made from octahedra consisting of single respective rope rings 75 such as those shown in FIGS. 14*a* and 14*b* and connecting rings 76 or chain connections 77 for connecting rod members 78. Alternatively, this inner net can be formed from large rope rings with octagonal meshes 61 or from two or more octahedrons each made from a single rope ring in which case quadrupling of the ropes at point 74 will result.

FIGS. 27*a* and 27*b* show a spatial configuration for the inner net consisting of cuboctahedra 79 truncated octahedra 57 and truncated tetrahedra 63. This inner net is fashioned from cuboctahedra each comprising one respective rope ring such as that shown at 79 in FIGS. 15*a* and 15*b*, and connecting rings 76 or chain connections 77 for connecting rod members 78. Together with the connecting rings 76, this inner net displays a nodal point 71 at which there are three ropes and nodal points 70 at which there are two ropes.

FIGS. 28*a* and 28*b* show a spatial configuration for the inner net consisting of cuboctahedra 79, cubes 65 and rhombicuboctahedra 82. This inner net is formed from cuboctahedra each comprising a single rope ring such as that shown at 79 in FIGS. 15*a* and 15*b* and quadrilateral connecting rings 80 or quadrilateral connecting surfaces 81 or quadrilateral, narrow meshed rope net surfaces 81*a*. The nodal points 71 between the connecting rings 80 or between the net surfaces 81*a* contain three ropes.

FIGS. 29*a* and 29*b* show a spatial configuration of the inner net consisting of rhombicuboctahedra 82, cubs 65 and tetrahedra, the latter being present only if the configuration is densely packed. This inner net is formed from rhombicuboctahedra 82 such as those shown in FIGS. 17*a* and 17*b*, each comprising a single rope ring and connecting rings 76 for connecting chains 77 or quadrilateral connecting surfaces consisting of membranes or sheets 126. This inner net, in general, displays nodal points 71 consisting of three ropes and only in the case of chain connections 77 displays nodal points 70 with two ropes.

FIGS. 30*a* and 30*b* show a spatial condiguration for the inner net consisting of octahedra 75 and cuboctahedra 79. This inner net is fashioned from individual octahedra 75 each comprising a single rope ring such as that shown in FIGS. 14*a* and 14*b* or from not densely packed cuboctahedra 79 each consisting of a single rope ring such as that shown in FIGS. 15*a* to 15*d*. The inner net displays nodal points 72 each consisting of four ropes.

FIGS. 31*a* and 31*b* show a spatial configuration for the inner net consisting of octahedra 75 and tetrahedra with doubled rims 128. This inner net is fashioned from octahedra 75 each consisting of a sinele rope ring such as that shown in FIGS. 14*a* and 14*b*, by means of short connecting members consisting of rings 83. This inner net displays nodal points 72*a* at which there are eight ropes and also nodal points at which there are four ropes.

FIGS. 32*a* and 32*b* show a spatial configuration for the inner net consisting of triangular prisms 84 and hexagonal prisms 85. This inner net is fashioned from plan rope rings 87 with triangular meshes 60 and vertically extending parallel groups of ropes 86. This inner net displays nodal points at which there are three ropes one of which is a rectilinear rope 91.

FIGS. 33*a* and 33*b* show a spatial configuration for the inner net consisting of cubes 65. This inner net is made from plne rope rings 89 and quadrilateral meshes 58 which are interlinked in chain form and from rectilinear groups of ropes 86 whose ends are joined to form a rope ring 90. This inner ring displays nodal points at which there are three ropes one of which is a rectilinear rope 91. This spatial configuration is particularly appropriate where the rectilinear ropes 91 extend horizontally.

FIGS. 34*a* and 34*b* show a spatial configuration of the inner net consisting of triangular prisms 84 which are fashioned from planar rope rings 87 with triangular meshes 84 and from rectilinear ropes 86. This inner net displays nodal points consisting of four ropes one of which is a rectilinear rope 92. This packing is also appropriate where the rectilinear ropes 86, the ends of which may be joined to form a rope ring 90, extend horizontally.

FIGS. 35*a* and 35*b* show a spatial configuration of the inner net in the form of a so-called "diamond" grid. This inner net, whilst it cannot be fashioned from complete polyhedra, can be fashioned from zig-zag rope rings 93. This inner net displays nodal points consisting of two ropes.

FIGS. 36*a* and 36*b* show a spatial configuration of the inner net consisting of zig-zag rope rings 94 and quadrilateral meshes 58. This inner net maay be thought of as a dense spatial packing consisting of truncated part octahedra 88 each of which has sixteen sides and displays nodal points 70 each consisting of two ropes.

FIGS. 37*a* and 37*b* show a spatial configuration for the inner net which is formed from rope rings 96 exteding in zig-zag configuration in ttwo planes and displays nodal points 72 each consisting of four ropes. This inner net may be thought of as being a dense packing of part octahedra 95 each of which has eight edges and or part tetrahedra each of which has six edges. This type of inner net may be produced very easily.

FIG. 38 shows a spatial network according to the present invention consisting of an octahedral outer net 1 formed by peripheral ropes 2. This outer net has six apexes which are extended and retained by mutually intersectiong compression members 3. This spatial network is intrensically strong and mobile and does not necessarily require to be anchored in the ground and may merely stand on three of the vertices of the outer net. An inner tensioning device 133 urges the peripheral ropes 2 outwardly so that the inner net is tensioned.

FIG. 39 shows a spatial network according to the present invention comrpising two of the spatial networks illustrated in FIG. 38. The spatial network shown in FIG. 39 is obtained by extending the peripheral ropes 2 at the surface 6 and providing an inner compression rod member 7.

FIG. 40 shows a further embodiment of a spatial network according to the present invention. In this embodiment the peripheral ropes 2 are anchored at the lateral vertices of the outer net in an external square consisting of compressively and flexually rigid rod members 97. Thus only a compressively rigid rod member 12, supported in a central base, penetrtes to the inner net 4. The entire spatial network is anchored in the central base by means of lower peripheral ropes 2*b* or by means of tensioning ropes 9.

FIG. 41 shows an embodiment of the spatial network according to the present invention in which four vertices of the outer net are anchored in a square consisting of compressively and flexurally rigid rod members 97 which is disposed in a vertical plane. The two remaining vertices of the outer net are anchored by means of long inner compressively rigid rod members 98 in such a way that the spatial network is intrinsically and is prevented from tipping over only by means of the tensionsing ropes 9. In this embodiment the outer net 1 is of octahedral shape.

FIG. 42 shows a spatial network according to the present invention which does not have any inner compressively rigid rod member. This spatial network is supported at three points elevated above the groun d, for exampmle, from trees 100. The peripheral ropes 2 are connected to suspension ropes 92 which in turn are connected to the trees. The three lower vertices of the outer net are secured to the ground via tensioning devices 27 in concrete blocks 20.

FIG. 43 shows an inner net 14 of a spatial network according to the present invention consisting of truncated octahedra 57 which are anchored directly in an octahedron consisting of flexurally rigid rod members 101 by meansof rope loops 32, the rod members 101 forming the outer net. The connection between the rope loops 32 and the rod members 101 is effected by hooks or lugs 102 or by means of springs.

FIG. 44 shows the rope track of an outer periphral rope net of a hemioctahedral outer net, with the outer peripheral rope net substantially representing a projection of the inner net and consisting of cuboctahedra 79. The peripheral rope net consists of a zig-zag rope ring 40 and a hexagonal rope ring 41. The peripheral rope net is connected with the sloping peripheral ropees 39 and the horizontal peripheral ropes 53 by hooks 131 or other rope clips. Only nodal points 72 consisting of three ropes occur.

FIGS. 45 and 46 show a relatively large spatial network accoring to the present invention. An inner net is built up from truncated octahedra 57 which is anchored in an outer net which is of a shape such that is represents substantially a projection of the inner net. A part of the inner net is anchored directly in the peripheral rope 39 via rope loops 32 while further rope loops 32*a* are connected to the outer net which, in this case, consists of hexagonal, short rope rings 43 connected to the peripheral ropes 39 and of short rope rings 41 as well as of further long rope loops 42 that are extensions of the lower rope net 47.

FIG. 47 shows, in cross-section, a further embodiment of a spatial network according to the present invention. This spatial network has a particularly favourable ratio of about 50 mesh units per rope joint i.e. with, on average, very long rope rings or very few rope joints (approximately 600 mesh units with only 12 rope joints). This spatial network consists of cuboctahedra 79 each consisting of a single rope ring, the cuboctahedra 79 being connected to each other and to the peripheral ropes 22 by long meandering rope rings 104. The inner net also consists of cubes 65 and quadralateral prisms and, in the outer region, incomplete rhombicub octahedra The outer net consists of a large octahedron 34 comprising a single rope ring in which a large cuboctahedron 103 comprising a single rope ring is streteched out respectively in the middle of an edge of the octahedron 34 as a simple peripheral rope net. Some quadralateral mesh sections are subdivided with narrow meshed rope nets 105 comprising one respective rope ring. This spatial network has nodal points 70 each consisting of two ropes and nodal points 71 each consisting of three ropes.

FIG, 48 is a vertical section through a spatial network the uter net of which is in the shape of a hemioctahedron. This spatial network, like that shown in FIG. 47, is built up from cuboctahedr 79 each consisting of a single rope ring, from cubes 65 and from meandering long rope rings 104. The oute net consists of a triangular peripheral rope ring 39 and of a rope ring secured thereto with large triangular meshes 40. This spatial network has a nodal point 70 consisting of two ropes and nodal points 71 consising of three ropes.

FIG. 49 shows a very important embodiment of a spatial network according to the present invention and has inner net and outer net each displaying meshes of varying lengths and consequently also distorted polyhedra. The inner net comprises truncated octahedra 57 with distorted quadrilateral mesh sections 127 and distorted rope loops 32 connecting the octahedra 57 to the outer net which is octahedral in form. A hemicuboctahedron is inserted in one corner region 134 and indicates that it is possible to combine different kinds of polyhedra within ont outer net.

FIG. 50 shows an inner net of a spatial network according to the present invention consisting of six rhombiuboctahedra 82 each consisting of one respective rope ring. The rhombicuboctahedra 82 are connected to each other and to the outer net by short chains 77 to whose ends S-shaped hooks (shown in FIGS. 57*a* and 57*b*) are secured. In addition, the inner net contains quadrilateral prisms 65*a* whilst in the middle thereof there is a rhombicuboctahedron having edges 82*a* of varying length. In this embodiment the inner net has only nodal points 70 consisting of two ropes. As in the other embodiments described above it is possible to employ springs with hooks attached at the ends thereof in place of the S-shaped hooks and in this connection attention is drawn to FIG. 57*b*. The result is a type of three-dimensional trampoline which is a very important further development of spatial networks according to the present invention in so far as they may be used as sports applicances for adults as well as children. The outer net in such an instance has six vertices and is octahedral in shape the ropes being doubled in the region 106 of the vertices.

FIG. 51 is an exploded view of a further embodiment of a spatial network according to the present invention which is formed by havin g a polyhedron with *n* vertices anchored respectively in the middle of an edge of a polyhedron with *n* edges. A rhombicuboctahedron 82 consisting of single rope ring and with 24 vertices is anchored in a cuboctahedron 79 consisting of one rope ring with 24 edges. The latter, in turn, is anchored in an octahedron 34 consisting of one rope ring. The octahedron 34 is anchored in a tetrahedron 107 two of its six edges comprising double ropes. All the nodal points 71 in this spatial network comprise three ropes.

FIG. 52 shows further embodiment of a spatial network according to the present invention in which the compressively acting elements are inflatable or filled spherical cushions 46 which support one another and put both the inner net 4 and the outer net 34 under tension. To increase the stability of this spatial network, the cushions at the bottom of the spatial network are filled with water or heavy fillers. Such a structure can float or, if the cushions are filled with gas, can fly.

FIG. 53 shows an outer net 34 which is octahedral in shape and which forms part of a spatiaal network according to the present invention. The outer net 34 is stretched by means of six tubular pneumatic compressively acting elements 108.

FIGS. 54*a* and 54*b* show a further embodiment of a spatial network according to the present invention with a tubular hose 108 and an internal compressively rigid rod member 98 between which the octahedral outer net 34 is stretched. The compressively rigid rod member 98 may be replaced by one or two further tubular rings or hoses 109 which are positioned perpendicular to the first ubular hose 108 so that the inner net 4 is anchored directly in the tubular hoses via loop-like extensions 136.

FIGS. 55*a*, 55*b* and 56 show further spatial networks according to the present invention. The spatial networks each consist of four outer nets 121 which are connected laterally at their vertices 130 an each of which is in the form of a hemioctahedron. The outer nets are anchored in concrete blocks 20 some of which are in common. Such spatial networks can be erected from individual networks and may include suspension bridge like connecting parts consisting of rope nets 110, connections fo beam-like or pipe-like components 137 or with connecting elements consisting of membranes 111. As seen in FIG. 56, the spatial network is constructed as a large versatile play appliance and enclosed structure and may include: a ropeway 116 streteched between the network 121 and trees or other structural components or between two networks 121; a chute 117 from an elevated point of the outer net to the ground or into water; a rope ladder 114 through the inner net 4 or from the outer net to the ground; interior equipment components consisting of panels 118 of wood or plastics material in the form of seats or bridges, with small houses 119 composed of triangular, quadrilatera, hexagonal or octagonal surfaces joined together with flat links or hooks secured to the ropes; further vertical or horizontal tensioned ropes 122 for climbing or carrying out horizontal movement exercises; swings 115*a* or motor car tyres 115 stretched underneath or between the spatial network; narrow meshed rope net surfaces 105 consisting of a single rope ring; membranes 112 stretched out beneath the spatial network which serve as a roof and as a safety net, connecting elements consisting of wide meshed rope nets 120 comprising a single rope ring which are equipped with seating surfaces 118 or troughs, and more particularly also with tent roofs 113 which cover the spatial network entirely or partially. The connecting elements which consist of membranes may be secured in trampoline-like manner to the lower, horizontal peripheral ropes 53 by means of spring hools such as those shown in FIG. 57*a*.

Figure 57A:
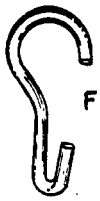

FIG. 57*a* shows an S-shaped hook made of material of circular cross-section, for example, stainless steel. This hook is suitable for the fabrication of almost all the knot connections that occur in spatial networks such as those described above. The loops formed in the S-shaped hool may be in one plane or at 90° to one another and it may have a longitudinal groove to augment any friction effect.

Figure 57B:
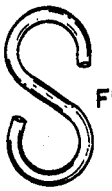

FIG. 57*b* shows a planar S-shaped hook made of material of circular cross-section and this S-shaped hook is designed to connect two co-planar ropes.

Figure 57C:
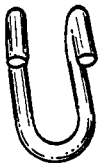

FIG. 57*c* shows a U-shaped hook which is used in those cases where particularly large forces arist at nodal points. This is the case particularly where there are peripheral ropes and peripheral rope nets.

Figure 57D:
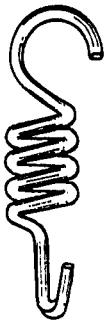

FIG. 57*d* shows a tensile spring with hooked ends, the hooked ends being pressed onto the ropes to be connected with a press tool or the like. For saftey purposes the spring part may be enveloped in an elastic or plastics tube.

FIG. 58*a* to 58*l* show typical examples for connecting two, three or four ropes together at nodal points of the inner nets and outer nets of the spatial networks according to the present invention.

Figure 58A:
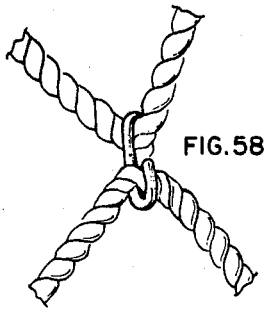

FIG. 58*a* shows the connection between two ropes lying in different planes using a S-shaped hook such as that shown in FIG. 57*a*.

Figure 58B:
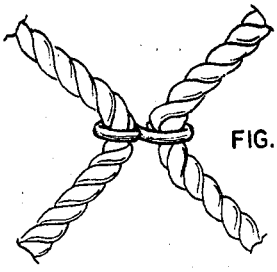

FIG. 58*b* shows the connection between two ropes which are co-planar using a S-shaped hook such as that shown in FIG. 57*b*.

Figure 58C:
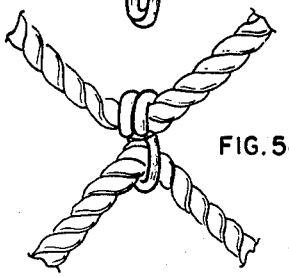

FIG. 58*c* shows the connection between two ropes which are to be subjected to particularly large forces using a hook such as that shown in FIG. 57*c*. A similar connection can be effected using two adjacent S-shaped hooks such as those shown in FIG. 57*a*.

Figure 58D:
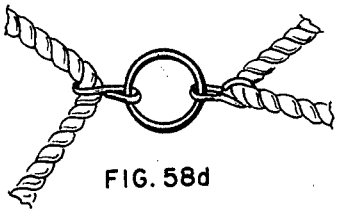
Figure 58E:
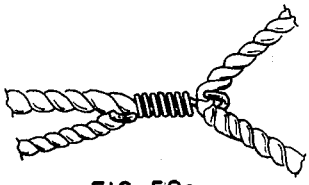

FIG. 58*d* shows the connection between two ropes in which the connection is extended by means of a thick circular ring, e.g. one or more chain links. In fact, any number of ropes may be connected to the ring by means of, for example, S-shaped hooks such as those shown in FIG. 57*a* or 57*b*. FIG. 58*e* shows the connection between two ropes using a tensile spring such as that illustrated in FIG. 57*d*.

Figure 58F:
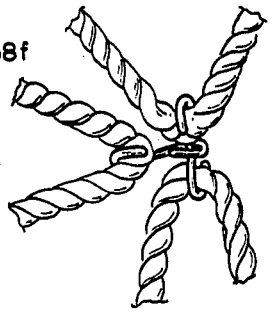

FIG. 58*f* shows the connection between two ropes using two S-shaped hooks as shown in FIG. 57*b* or using one S-shaped hook as shown in FIG. 57*a* and one S-shaped hook as shown in FIG. 57*b*.

Figure 58G:
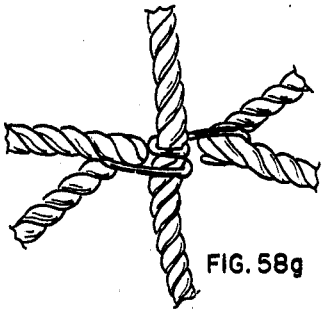

FIG. 58*g* shows the connection between threee ropes using S-shaped hooks such as shown in FIG. 57*a* and/or FIG. 57*b*.

Figure 58H:
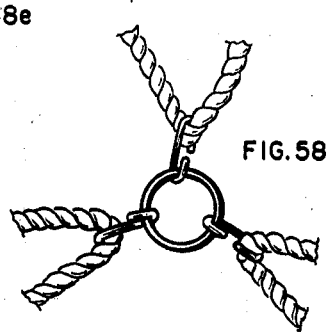

FIG. 58*h* shows the connection between three ropes making a desired angle to each other using a circular ring such as that shown in FIG. 58*d*.

FIG. 58*i* shows the connection of four ropes using S-shaped hooks such as shown in FIG. 57*a* and/or 57*b*.

Figure 58K:
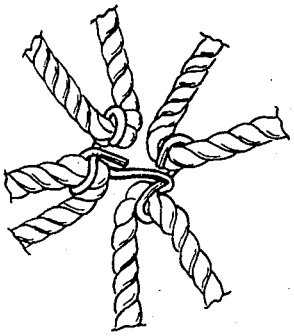
Figure 58K:
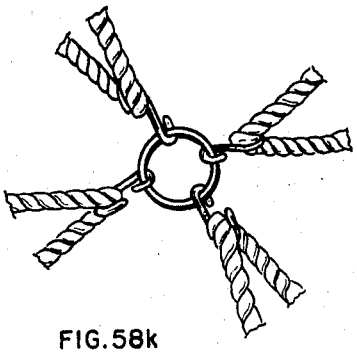

FIG. 58*k* shows the connection of four ropes using a circular ring together with S-shaped hooks.

FIG. 59 shows a spherical knot piece for connecting two ropes. The spherical knot piece consists of two hemispheres each of which has a groove of semi-circular cross-section therein for receiving a rope. The two hemispheres are connected together by means of bolts.

It is clear in many instances that with spatial networks according to the present invention the provision of at least a few compressively rigid members is essential (because of space requirements). However, in order to be able to make the members as thin as possible and yet obtain a staisfactory resistance to buckling, transverse struts may be necessary on the rod members. Such transverse struts are fixed to the inner net so that the rigid rod members are at least partially supported by the inner net itself. Within individual meshes of the inner net it is likewise feasible to clamp rigid rings with the aid of rope rings and through which rigid rings the rod members are supported at intermediate points. In such a case also the buckling strength of the rod members is increased because of the additional clamping or guiding by the rigid rings, and consequently the cross-section of the rod members can be reduced.

Under certain circumstances the outer net may be made from inflatable hoses. In such a case the provision of rod members is unnecessary because the inflatable hoses take on the tensioning function.

In place of the rope loops attached to the inner net or the shorter rope pieces or rings secured to the inner net, it is possible, for the purpose of securing the inner net to the outer net, to carry out a deformation outwardly of the inner net so that the inner net passes into the outer net more or less without a transition.

The ends of the ropes may be connected with the aid of doubly tapering sleeves in place of the deformable press-on sleeves referred to above. Two rope ends are placed in the ends of such a doubly tapering sleeve and then plastics material is injected through a lateral opening in the sleeve to affix the two ropes therein.

The connection of the individual ropes to one another is, as mentioned above effected suitably with the aid of S-shaped hooks whose loops are clamped fast to the ropes to be joined with the aid of a tensioning tool. Where a detachable joint, however, is desired, it is possible to employ two S-shaped hooks with respectively one loop of each S-shaped hook being clamped fast to one rope while the other two loops can be connected to one another in a detachable manner. To obtain the improved clamping effect the inner surfaces of the S-shaped hooks are suitably provided with transverse grooves. Furthermore, the two-loops of the S-shaped hooks may be mutually displaced by 90° in order that two ropes can be connected which are at an angle of 90° to one another. The ropes for the inner and outer nets may be steel ropes which may be provided with flexible inner core of fibrous material. The individual strands of the steel ropes are coated with plastics material to facilitate handling and to give a satisfactory surface protection. However, instead of coating the individual strands of the steep ropes, the entire rope may be provided with a coating of plastics material, for example, one of polyvinyl chloride.

In order to enhance the play value of such a clamping frame, the individual mesh sections haave associated with them respective laminar structures made of boiling water resistant plywood, plastics material panels, transparent acrylic panels, heavyweight woven fabric, lattice film structures or inflatable flat double membranes. Such laminar structures may be used as a seat, a back support, platform, roof, side walls, etc. Either these laminar structures may be inserted at the time of fabrication of the inner net to form part of the inner net, or they may be suspended in already existing inner nets subsequently. Such laminar structures may also be stretched around the outer net to yield float-like bodies.

Further polyhedra forming a fine structure may be inserted into the individul polyhedra of the inner net. Suitably, the corners of internally located small polyhedra are arranged to lie in the region of the middle of the edges of the externally located polyhedra; this means that the number of the vertices of the inner polyhedron must equal the number of edges of the outer polyhedron. This is the case, for example, with a cuboctahedron mounted within an octahedron.

In the above description the expression "rope" has been used generally for simplicity's sake. However, it is to be understood that this expression denotes tensionally rigid elements quite generally and includes flexible tapes, chains, hoses, and, under certin circumatances, also flexible tensionally rigid rods which may, for example, be provided with a coating of plastics material.

The "mesh" has been used generally also for simplicity's sake. The edges of each of the polygons together define planes and a plurality of such planes define a structure that has a net-like appearance. Thus, the mesh of the net-like structure refers to the standlike elements that define the aforementioned polygons.

The spatial networks described above have numerous applications such as, for example, a shelf, dry frame, multi-tier bed, multi-storey sun terrace, "hanging garden" as a frame for plant pots and bowls, trellis work, summerhouse, beach and exhibition pavilion, exhibition frame e.g. in large department stores, large seat and/or reclining furniture in several planes, laboratory scaffolding, etc.

The embodiments of the invention in which an exclusive property or privilege is claimed are defined as follows:

1. A spatial network, in particular a climbing device for children, comprising a three-dimensional inner net of tensile members, and a three-dimensional outer net which serves to hold the inner net , said three-dimensional outer net comprises tensile members forming polyhedra and polygonally curved edges and doubly-curved faces, said polyhedra having no more than eight vertices and having their faces, in operation, at an angle to the vertical and said three-dimensional inner net comprises at least one tensile member forming a continuous ring, said ring forming several interlinked polygons having faces defined by its edges which consist of said tensile members.

2. A spatial network according to claim 1, wherein the inner net comprises truncated tetrahedra and is built up from rings of interlinked triangular meshes.

3. A spatial network according to claim 1, wherein the inner net represents the edges of close-packed truncated octahedra and is builds up from rings of interlinked quadrilateral meshes.

4. A spatial network according to claim 1, wherein the inner net represents the edges of close-packed truncated cubes, truncated tetrahedra and truncated cuboctahedra and is build up from rings of interlinked quadrilateral and triangular meshes.

5. A spatial network according to Claim 1, wherein the inner net represents the edges of close-packed cubes and truncated cubes (polyhedra comprising six quadrangles and twelve hexagons) and is built up from rings of interlinked quadrilateral meshes and hexagonal meshes.

6. A spatial network according to claim 1, wherein the inner net represents the edges of close-packed truncated octahedra, cubes and truncated cuboctahedra and is built up from rings of quadrilateral meshes nd octagonal meshes.

7. A spatial network according to claim 1, wherein the inner net represents the edges of close-packed octagonal prisms and truncated cuboctahedra and is built up from rings of interlinked octagonal meshes.

8. A spatial network according to clain 1, wherein the inner net represents the edges of close-packed rhombic dodecahedra and is built up from rings of rhombic quadrilateral meshes.

9. A spatial network according to claim 1, wherein the inner net represents the edges of close-packed rhombic-hexagonal dodecahedra and is built up from rings of interlinked hexagonal meshes.

10. A spatial network according to claim 1, wherein the inner net represents the edges of close-packed octahedra and truncated cubes and is built up teom octahedra made from one single ring each connected to one another by connecting means.

11. A spatial network according to claim 10, wherein a plurality of said octahedra are built up from a single continuous ring.

12. A spatial network according to claim 1, wherein the inner net represents the edges of close-packed cuboctahedra, truncated octahedra and truncated tetrahedra and is built up from cuboctahedra made from one single ring each connected to one another by connecting means.

13. A spatial network according to claim 1, wherein the inner net represents the edges of close-packed cuboctahedra, cubes and rhombicuboctahedra and is built up from cuboctahedra made from one single ring each connected to one another by connecting means.

14. A spatial network according to claim 13, wherein the inner net is guilt up from rhombicuboctahedra made from one single ring each connected to one another directly at their vertices.

15. A spatial network according to claim 1, wherein the inner net represents the edges of close-packed rhombicuboctahedra, cubes and tetrahedra and is built up from rhombicuboctahedra made from one single ring each connected to one another by connecting means.

16. A spatial network according to claim 1, wherein the inner net represents the edges of close-packed octahedra and cuboctahedra and is built up from octahedra made from one individual ring each.

17. A spatial network according to claim 1, wherein the inner net represents the edges of close-packed octahedra and tetrahedra (with double edges) and is built up from octahedra made from one single ring each connected to one another by means of S-shaped hooks and connecting circular rings.

18. A spatial network according to claim 1, wherein the inner net represents the edges of close-packed triangular prisms and hexagonal prisms and is built up from normally planar rings of interlinked polygonal meshes forming a planar net, and from a plurality of rectilinear tensile members the ends of which may be connected to form continuous rings.

19. A spatial network according to claim 1, wherein the inner net represents the edges of close-packed cubes and is built up from normally planar rings of interlinked quadrilateral meshes forming a planer net, and form a plurality of rectilinear tensile members and ends of which may be connected to form continuous rings.

20. A spatial network according to claim 1, wherein the inner net represents the edges of close-packed triangular prisms and is built up from planar rings of interlinked triangular meshes forming a net, and from a plurality of rectilinear members the ends of which may be connected to form continuous rings.

21. A spatial network according to claim 1, wherein the inner net represents the edges of a diamond lattice and is built up from zig-zag shaped rings which extend in mutually perpendicular planes.

22. A spatial network according to claim 1, wherein the inner net represents the edges of close-packed partial truncated octahedra comprising only 16 edges and only two planar faces and is built up from zig-zag shaped rings with quadrilateral meshes which extend in planes perpendicular to the zig-zag planes.

23. A spatial network according to claim 1, wherein the inner net is built up from zig-zag shaped rings with triangular meshes and whose plan is a net of triangles and twelve-sided polygons.

24. A spatial network according to claim 1, wherein the inner net represents the edges of partial octahedra with only eight edges each and partial tetrahedra with only four edges each, i.e. polyhedra with curved surfaces, and is built up from zig-zag shaped rings which extend around the edges of at least one octahedra.

25. A spatial network according to claim 1, wherein the outer net has the shape of one of a tetrahedron, hemioctahefron, hexadeltahedron, an octahedron, a triangular prism, a pentahedron, an heptahedron, a five-sided pyramid, a six-sided pyramid, a hexahedron, rhomobohedron, a hemicuboctahedron, a cubic antiprism, a truncated tetrahedron, and a truncated hemioctahedron.

26. A spatial network according to claim 1, wherein the outer net has at least one truncated vertex.

27. A spatial network according to claim 26, wherein at least two outer nets are provided which are connected in the region of their truncated vertices forming a continuous outer net structure.

28. A spatial network according to claim 1, including at least one compressively rigid member for supporting or assisting in supporting the network.

29. A spatial network according to claim 28, wherein a plurality of compressively rigid members are provided each with transverse struts secured to the inner net.

30. A spatial network according to claim 28 including a narrow ring fixed to at least one of the inner net and outer net, said compressively rigid member passing theough said narrow ring.

31. A spatial network according to claim 1 including inflatable structure elements for supporting the network.

32. A spatial network according to claim 1 including at least one S-shaped hook for connecting together at least two tensile members, said hook being clamped to said tensile members.

33. A spatial network according to claim 32, wherein the two loops of the hook are in mutually perpendicular planes.

34. A spatial network according to claim 1 including plate-type polygonal elements inserted into the inner net preferably by S-shaped hooks.

35. A spatial network according to claim 1, wherein at least one of the entire inner net and outer net is built up from a single very long rope ring.

36. A spatial network according to claim 1, wherein at least one of the outer net and the inner net is built up from interlinked polyhedra made from one single rope ring each.

37. A spatial network according to claim 1 inclusing polygonal tensil surface clements as integral parts of at least one of the inner and outer net replacing said tensile members.

38. A spatial network according to claim 37, wherein said tensile surface elements are connected to said tensile members by means of S-shaped hooks.

39. A spatial network according to claim 1, wherein at least two networks of equal edge length are connected along at least one location to form groups of networks.

40. A spatial network according to claim 1, wherein additional climbing and play devices are suspended between the network and the ground.

41. A spatial network according to claim 40, wherein said climbing and play devices are suspension-bridge type connecting elements.

42. A spatial network according to claim 1, wherein the inner net is supported and anchored between surface structures.

43. A spatial netowrk, in particular a climbing device for children, comprising a three-dimensional inner net of tensile members, an outer net comprising compression membrs which serve to hold the inner net, said three-dimensional inner net consisting of at least one tensile member formine a continuous ring, said ring forming several interlinked polygons having faces defined by its edges which consist of said tensile members.

44. A spatial network, in particular a climbing device for children, comprising a three-dimensional inner net of tensile members, an outer net comprising bending members subject to bending moments which serve to hold the inner net, said three-dimensional inner net consisting of at least one tensile member forming a continuous ring, said ring forming several-interlinked polygons having faces defined by its edges which consist of said tensile members.

45. A spatial network according to claim 1, wherein the inner net comprises truncated tetrahedra and is built up from rings of interlinked triangular and quadrilateral meshes.

46. A spatial network according to claim 1, wherein the inner net represents the edges of close-packed octahedra and cuboctahedra and is built up from several octahedra made from one continuous ring.

47. A spatial network according to claim 1 wherein the inner net represents the edges of close-packed octahedra and cubotahedra and is built up from cuboctahedra made from one individual ring each.

48. A spatial network according to claim 1, wherein the inner net represents the edges of rhombic hexahedra with quadrilataeral meshes and is built up from normally planar rings of interlinked quadrilateral meshes forming a planar net, and from a plurality of rectilinear tensile members the ends of which may be connected to form continuour rings.

* * * * *

UNITED STATES PATENT OFFICE
CERTIFICATE OF CORRECTION

Patent No. 3,790,301 Dated February 5, 1974

Inventor(s) Henry Valdemar Pedersen et al.

It is certified that error appears in the above-identified patent and that said Letters Patent are hereby corrected as shown below:

In the drawings, cancel sheet 1 containing Figs. 1 and 2, and substitute the attached sheet.

Signed and sealed this 10th day of September 1974.

(SEAL)
Attest;

McCOY M. GIBSON, JR.
Attesting Officer

C. MARSHALL DANN
Commissioner of Patents

USCOMM-DC 60376-P69
★ U.S. GOVERNMENT PRINTING OFFICE : 1969 O—366-334.

UNITED STATES PATENT OFFICE

CERTIFICATE OF CORRECTION

Patent No. 3 970 301 Dated July 20, 1976

Inventor(s) Conrad Roland Lehmann

It is certified that error appears in the above-identified patent and that said Letters Patent are hereby corrected as shown below:

Column 2, line 58; change "element" to ---elements---.

Column 3, line 32; change "netowrk" to ---network---.

Column 4, line 48; change "show" to ---shows---.

Column 4, line 62; change "constrction" to ---construction---.

Column 6, line 55; change "to lower" to ---to a lower---.

Column 7, line 9; change "cub-octahedra" to ---cuboctahedra---.

Column 8, line 9; change "mde" to ---made---.

Column 8, line 21; change "conprising" to ---comprising---.

Column 8, line 30; change "pentahedronn" to ---pentahedron---.

Column 9, line 1; change "displsys" to ---displays---.

Column 9, line 7; change "quadrilteral" to ---quadrilateral---.

Column 9, line 60; change "cubs" to ---cubes---.

Column 10, line 3; change "condiguration" to ---configuration---.

Column 10, line 15; change "sinele" to ---single---.

Column 10, line 30; change "plne" to ---plane---.

UNITED STATES PATENT OFFICE

CERTIFICATE OF CORRECTION

Patent No. 3 970 301 Dated July 20, 1976

Inventor(s) Conrad Roland Lehmann

It is certified that error appears in the above-identified patent and that said Letters Patent are hereby corrected as shown below:

Column 10, line 55; change "maay" to ---may---.

Column 10, lines 60 and 61; change "exteding" to ---extending---.

Column 10, line 61; change "ttwo" to ---two---.

Column 10, line 64; change "and or" to ---and of---.

Column 11, line 3; change "intersectiong" to ---intersecting---.

Column 11, line 4; change "intrensically" to ---intrinsically---.

Column 11, line 11; change "comrpising" to ---comprising---.

Column 11, line 20; change "flexually" to ---flexurally---.

Column 11, line 22; change "penetrtes" to ---penetrates---.

Column 11, line 33; change "intrinsically and " to ---intrinsically stable and---.

Column 11, lines 34 and 35; change "tensionsing" to ---tensioning---.

Column 11, line 39; change "member" to ---members---.

Column 11, line 41; change "exampmle" to ---example---.

Column 11, line 60; change "ropees" to ---ropes---.

CERTIFICATE OF CORRECTION

Patent No. 3 970 301 Dated July 20, 1976

Inventor(s) Conrad Roland Lehmann

It is certified that error appears in the above-identified patent and that said Letters Patent are hereby corrected as shown below:

Column 11, line 62; change "72" to ---71---.

Column 11, line 67; change "that is" to ---that it---.

Column 12, line 31; change "uter" to ---outer---.

Column 12, line 33; change "cuboctahedr" to ---cuboctahedra---.

Column 12, line 35; change "oute" to ---outer---.

Column 12, line 50; change "ont" to ---one---.

Column 12, lines 52 and 53; change "rhombiuboctahedra" to ---rhombicuboctahedra---.

Column 13, line 17; change "shows further" to ---shows a further---.

Column 13, line 27; change "spatiaal" to ---spatial---.

Column 13, line 44; change "an each" to ---and each---.

Column 13, line 50; change "fo beam-like" to ---of beam-like---.

Column 14, line 11; change "spring hools" to ---spring hooks---.

Column 14, line 12; change "57a" to ---57d---.

Column 14, line 18; change "S-shaped hool" to ---S-shaped hook---.

CERTIFICATE OF CORRECTION

Patent No. 3 970 301 Dated July 20, 1976

Inventor(s) Conrad Roland Lehmann

It is certified that error appears in the above-identified patent and that said Letters Patent are hereby corrected as shown below:

Column 14, line 25; change "arist" to ---arise---.

Column 14, line 61; change "threee" to ---three---.

Column 15, line 13; change "staisfactory" to ---satisfactory---.

Column 15, line 57; change "with flexible" to ---with a flexible---.

Column 15, lines 64 and 65; change "clamping frame" to ---climbing frame---.

Column 15, line 65; change "haave" to ---have---.

Column 16, line 23; change "certin" to ---certain---.

Column 16, line 62; change "buils up" to ---built up---.

Column 17, line 10; change "meshes nd" to ---meshes and---.

Column 17, line 16; change "Clain 1" to ---Claim 1---.

Column 17, line 26; change "teom" to ---from---.

Column 17, line 44; change "guilt" to ---built---.

Column 18, lines 7 and 8; change "and ends" to ---the ends---.

UNITED STATES PATENT OFFICE
CERTIFICATE OF CORRECTION

Patent No. 3 970 301 Dated July 20, 1976

Inventor(s) Conrad Roland Lehmann

It is certified that error appears in the above-identified patent and that said Letters Patent are hereby corrected as shown below:

Column 18; line 38; change "hemioctahefron" to ---hemioctahedron---.

Column 18, line 41; change "rhomobohedron" to ---rhombohedron---.

Column 18, line 61; change "theough" to ---through---.

Column 19, line 14; change "inclusing" to ---including---.

Column 19, line 15; change "clements" to ---elements---.

Column 19, line 34; change "netowrk" to ---network---.

Column 20, line 1; change "membrs" to ---members---.

Column 20, line 3; change "formine" to ---forming---.

Column 20, line 27; change "cubotahedra" to ---cuboctahedra---.

UNITED STATES PATENT OFFICE

CERTIFICATE OF CORRECTION

Patent No. 3,970,301 Dated July 20, 1976

Inventor(s) Conrad Roland Lehmann Page 6 of 6

It is certified that error appears in the above-identified patent and that said Letters Patent are hereby corrected as shown below:

Column 20, line 31; change "quadrilataeral" to -- quadrilateral --.

Column 20, line 35; change "continuour" to -- continuous --.

Signed and Sealed this Seventeenth Day of May 1977

[SEAL]

*Attest:*

RUTH C. MASON
*Attesting Officer*

C. MARSHALL DANN
*Commissioner of Patents and Trademarks*